US008366732B2

(12) United States Patent
Kim

(10) Patent No.: US 8,366,732 B2
(45) Date of Patent: Feb. 5, 2013

(54) CONSECUTIVE ACUPUNCTURE DEVICE AND CARTRIDGE FOR CONSECUTIVE ACUPUNCTURE DEVICE

(75) Inventor: Hyeon Ho Kim, Seoul (KR)

(73) Assignee: Neo Dr. Inc., Gangwondo (KR)

( * ) Notice: Subject to any disclaimer, the term of this patent is extended or adjusted under 35 U.S.C. 154(b) by 303 days.

(21) Appl. No.: 12/669,478

(22) PCT Filed: Jul. 11, 2008

(86) PCT No.: PCT/KR2008/004100

§ 371 (c)(1),
(2), (4) Date: Jan. 15, 2010

(87) PCT Pub. No.: WO2009/011522

PCT Pub. Date: Jan. 22, 2009

(65) Prior Publication Data

US 2010/0191269 A1 Jul. 29, 2010

(30) Foreign Application Priority Data

Jul. 18, 2007 (KR) ..... 10-2007-0071790
Mar. 21, 2008 (KR) ..... 10-2008-0026192
Mar. 21, 2008 (KR) ..... 10-2008-0026193

(51) Int. Cl.
*A61B 17/34* (2006.01)

(52) U.S. Cl. ..... 606/189; 606/181; 606/182

(58) Field of Classification Search ..... 606/189, 606/204, 185, 181, 172, 182–184; 601/134; 128/907; 206/366; 221/363, 212, 270; 604/61; 600/583

See application file for complete search history.

(56) References Cited

U.S. PATENT DOCUMENTS

| | | | | |
|---|---|---|---|---|
| 6,852,119 | B1 * | 2/2005 | Abulhaj et al. | 606/182 |
| 2003/0187470 | A1 * | 10/2003 | Chelak et al. | 606/182 |
| 2004/0260324 | A1 * | 12/2004 | Fukuzawa et al. | 606/181 |
| 2005/0067310 | A1 * | 3/2005 | Choi | 206/366 |
| 2005/0203545 | A1 * | 9/2005 | Cole | 606/133 |
| 2008/0097505 | A1 | 4/2008 | Kim | |

FOREIGN PATENT DOCUMENTS

| | | |
|---|---|---|
| KR | 1993-0001886 | 2/1993 |
| KR | 1993-0023025 | 12/1993 |
| KR | 2000-0018417 | 10/2000 |
| KR | 10-0497115 | 6/2005 |
| KR | 10-0553006 | 2/2006 |
| KR | 10-0585844 | 5/2006 |

OTHER PUBLICATIONS

International Search Report mailed Oct. 1, 2008 for International Application No. PCT/KR2008/004100.
KR 10-0585844 abstract.
KR 10-0553006 abstract.
KR 10-0497115 abstract.

* cited by examiner

*Primary Examiner* — Ryan Severson
*Assistant Examiner* — Tin Nguyen
(74) *Attorney, Agent, or Firm* — Rabin & Berdo, P.C.

(57) ABSTRACT

A cartridge for a consecutive acupuncture device includes a needle storage space in which at least one needle is stored, a charge slot serving as a passage for connecting the needle storage space with a striking position in order to allow sequentially loading of the needles at the striking position, and a catch step formed on at least part of the charge slot in order to prevent the neighboring needle from being discharged together when the needle is loaded at the striking position and then is struck and administered.

8 Claims, 29 Drawing Sheets

(a)

(b)

300

CONSECUTIVE ACUPUNCTURE DEVICE AND CARTRIDGE FOR CONSECUTIVE ACUPUNCTURE DEVICE

TECHNICAL FIELD

The present invention relates, in general, to a consecutive acupuncture device and a cartridge for the consecutive acupuncture device and, more particularly, to a consecutive acupuncture device which prevents a phenomenon wherein arrangement of needles stored in a cartridge is disturbed due to vibrations caused by external impact and frequent variation in acupuncture angle while the needles are administered into affected parts, a loading inability phenomenon caused by a bottleneck phenomenon which the needles attracted to a striking position by means of the magnetic force experience at the entrance of a charge slot, and another loading inability phenomenon occurring when a hammer plunger which strikes the needle so as to allow the administration of needles serves as a fulcrum and is returned to its former position, thereby allowing the needles stored in the cartridge to be sequentially loaded and thus enabling a consumer to use the consecutive acupuncture device without anxiety; and a cartridge for the consecutive acupuncture device, which enables pushing a button with one hand to consecutively administer needles in the state in which the needles are randomly stored in a cartridge, thereby reducing time required for administering acupuncture, plus enabling a user to administer acupuncture in an easy, sanitary manner, enabling a patient to escape from anxiety before the acupuncture is administered because the needles are not visible, and reducing pain owing to an instantaneous striking method when the acupuncture is administered.

BACKGROUND ART

In general, a consecutive acupuncture device is an acupuncture device that can consecutively insert needles into the human body. One example of the technology associated with this consecutive acupuncture device is a "consecutive acupuncture device" disclosed in Korean Patent No. 10-0585844 filed by the applicant of the present invention.

In claim 1 of Korean Patent No. 10-0585844, as illustrated in FIG. 1, the consecutive acupuncture device, which can consecutively insert needles, comprises a cartridge 1 in which one or more needles are stored, a first magnet 4 that is located on one side of the cartridge 1 and causes the stored needle to be attracted and automatically disposed to an acupuncture point by magnetic force, a striking means that is located on an upper side of the cartridge 1 and strikes the needle previously located at the acupuncture point so as to insert the needle into the acupuncture point, and a discharging section 30 that is located on a lower side of the cartridge 1 and is provided with a hole through which the needle is discharged. The striking means includes a button 23 that is installed on the upper side of the cartridge 1 so as to be elastically biased upwards by a return spring 22, a hammer 26 that is installed in the button 23 so as to be elastically biased downwards by a striking spring 25, a hammer nose that is provided with an ascending slope on one side of the hammer 26, a compression step that is formed on a lower side of the hammer nose such that the hammer nose is caught in such a manner as to compress the striking spring 25 to a predetermined position when the button 23 is pushed, and a release step that is formed on an upper side of the hammer nose such that the slope of the hammer nose is pressed to cause the hammer nose to be separated from the compression step when the striking spring 25 is compressed up to or past a predetermined length.

Meanwhile, the cartridge of the consecutive acupuncture device is mounted on the consecutive acupuncture device, has a structure in which the needles 10 can be sequentially loaded at the position where a hammer plunger 6 of the consecutive acupuncture device strikes the needle (see FIG. 3).

In detail, as illustrated in FIG. 2, the needles 10 stored in the cartridge 1 are attracted to and loaded at the striking position of the hammer plunger 6 through a charge slot by the magnet 4 installed in the consecutive acupuncture device. The second magnet 5 can prevent the needles from falling due to gravity. As the hammer plunger 6 strikes an upper end of the needle 10, the needle 10 is instantaneously discharged in a downward direction, and thereby is inserted into an affected part of the human body. When the hammer plunger 6 returns to its original position, another waiting needle is loaded at the striking position by the first magnet 4.

In this manner, in order to smoothly position the needles 10 stored in the cartridge 1 in the charge slot, the needles 10 stored in the cartridge 1 must be arranged in an upwardly attracted state by the second magnet 5.

However, since the needles 10 stored in the cartridge 1 are instantaneously attracted and attached toward the charge slot by the first magnet 4, which is located on a sidewall of the consecutive acupuncture device, from the moment when the cartridge 1 is coupled to the consecutive acupuncture device, the consecutive acupuncture device undergoes malfunction in such a manner that the needles 10 fail to be attracted upwards through the second magnet 5, are not smoothly pushed into the charge slot, and are thus caught at an entrance of the charge slot.

Further, when the hammer plunger 6 does not completely strike the needle 10 loaded at the striking position and then returns to its original position due to the carelessness of a user, one point P1 of the upper end of the needle 10 pushed in a downward direction from the striking position serves as a fulcrum, as illustrated in FIGS. 3 and 4. Thus, the needles 10 arranged in turn in the charge slot are inclined to the right of FIG. 4 at the upper ends thereof, and to the left of FIG. 4 at the lower ends thereof. As a result, when the inclined next needle 10 is struck when inserted, the next needle 10 is not discharged, i.e. causing the malfunction to take place.

Moreover, when the hammer plunger 6 attempts to strike the needle in the aforementioned state, the needle 10 is caught by the catch step of the charge slot, and thus is abnormally inserted. Thus, the cartridge 1 is pushed in a downward direction, and then is separated from the consecutive acupuncture device.

Further, the cartridge 1 becomes loose owing to the process of repetitive coupling with and decoupling from the consecutive acupuncture device. In certain cases, the cartridge 1 becomes separated from the consecutive acupuncture device.

Meanwhile, the cartridge of the consecutive acupuncture device (hereinafter, collectively referred to as "cartridge") mounted on the aforementioned consecutive acupuncture device is configured such that the needles can be sequentially loaded at the striking position at which the hammer plunger of the consecutive acupuncture device strikes each needle.

Specifically, as illustrated in FIG. 5, the needles 10 stored in the cartridge 1 are sequentially attracted to and loaded at the striking position of the hammer plunger 6 by the magnetic force of the first magnet 4 installed on the consecutive acupuncture device. When being so loaded, each needle 10 is prevented from falling in the gravitational direction by the magnetic force of the second magnet 5.

Each of the needles 10, which are sequentially loaded at the striking position of the hammer plunger 6, is instantaneously discharged in a downward direction when the hammer plunger 6 strikes the upper end of each needle, and thereby is inserted into the acupuncture point.

At this time, when the hamster plunger 6 strikes each needle 10 at the striking position and thus discharges the needle 10 in a downward direction, there is a problem in that another neighboring needle 10 moves downwards along with the discharged needle.

The needles 10 stored in the cartridge 10 are severely fluctuated from one end to the other end of the interior of the cartridge by vibration of the consecutive acupuncture device. Accordingly, some of the needles 10 are not arranged in parallel respective to the entrance of the charge slot, and are inclined to one side as in FIG. 12. Some of these inclined needles 10 block the entrance to the charge slot, and thus other needles 10 cannot enter the charge slot.

Meanwhile, the needles 10 stored in the cartridge 10 are fed along the charge slot in the state which they are attracted upwards by the magnetic force of the second magnet located above. In this case, as illustrated in FIG. 5, the upwardly attracted needles 10 deviate from their original positions in a downward direction, and thus smoothly enter into the charge slot, due to vibration caused by external impact and frequent variation in acupuncture angle while the needles 10 are applied using the consecutive acupuncture device.

Further, as illustrated in FIG. 6, when the hammer plunger 6 strikes the loaded needle 10 and then completely returns to its original position, one point P2 of the lower end of the hammer plunger 6 instantaneously serves as a fulcrum. Thus, the needles 10, which are sequentially arranged in the charge slot, are inclined to the left side at the upper ends thereof, and to the right side at the lower ends thereof, as illustrated in FIG. 6.

When the upper ends of the needles 10 are inclined to the left side as illustrated in FIG. 6, the needles 10, which are sequentially arranged in the charge slot, are pushed in the direction of the arrow as viewed from the right side of FIG. 7, and thus the uppermost needle 10*a* is pushed toward a needle storage space at an upper end thereof, as illustrated in FIG. 6. Both needles 10*b* and 10*c* located on opposite sides of the charge slot try to enter into the charge slot under the influence of the magnetic force. This results in the malfunction that the uppermost needle 10*a* and both needles 10*b* and 10*c* are mutually crossed and twisted in a "X" shape, and thus the entrance to the charge slot becomes blocked.

DISCLOSURE

Technical Problem

Accordingly, the present invention has been made in an effort to solve the problems occurring in the related art, and embodiments of the present invention provide a consecutive acupuncture device, which prevents a malfunction caused by carelessness of a user, and a loading inability phenomenon occurring when a hammer plunger striking the needle for piercing serves as a fulcrum when returned, and separation of the cartridge; a cartridge for the consecutive acupuncture device, which prevents a phenomenon whereby arrangement of the needles stored in the cartridge is disrupted due to vibration caused by external impact and frequent variation in acupuncture angle while the needles are administered into affected parts, and finally which prevents a loading inability phenomenon caused by a bottleneck phenomenon wherein the needles are attracted to the striking position by means of the magnetic force at the entrance of a charge slot, thereby allowing the needles stored in the cartridge to be sequentially loaded, enabling a consumer to use the consecutive acupuncture device without anxiety, and remarkably improving reliability of the consecutive acupuncture device.

Technical Solution

In an exemplary embodiment of the present invention, there is provided a consecutive acupuncture device that consecutively supplies piercing needles. The consecutive acupuncture device comprises: an acupuncture device body having a mounting hole for mounting a cartridge in which at least one needle is stored, and a striking means for striking one of the stored needles loaded at a striking position of the consecutive acupuncture device so as to pierce the needle into an affected part; and a magnetic force generator having a first magnet mounted therein such that a magnetic force does not exert an influence on the needles stored in the cartridge while the cartridge is mounted in the mounting hole, but exerts an influence on the needles stored in the cartridge after the cartridge is mounted so as to sequentially load the needles stored in the cartridge at the striking position of the cartridge, the magnetic force generator being pivotably, slidably or detachably installed to a position adjacent to or away from one side of the acupuncture device body.

According to an aspect of the present invention, the consecutive acupuncture device may further comprise a second magnet located on one side of the acupuncture device body corresponding to an upper part of the cartridge mounted in the mounting hole and attracting the needles in an upward direction such that tips of the needles stored in the cartridge do not touch a bottom of the cartridge.

According to another aspect of the present invention, the magnetic force generator and the cartridge may include a locking protrusion and a locking recess at mutually corresponding positions, respectively. The locking protrusion of the magnetic force generator may be fitted into the locking recess of the cartridge so as to lock the cartridge to prevent the cartridge from becoming separated when the magnetic force generator pivots, slides or is attached to a position adjacent to one side of the cartridge, whereas the locking protrusion of the magnetic force generator is separated from the locking recess of the cartridge so as to unlock the cartridge to enable the cartridge to be separated when the magnetic force generator is pivoted, slides or is detached from a position away from one side of the cartridge.

According to another aspect of the present invention, the striking means of the acupuncture device body may include a button installed on an upper part of the cartridge mounted in the mounting hole so as to be elastically biased upwards by a return spring, a hammer installed in the button so as to be elastically biased downwards by a striking spring, a hammer nose having an ascending slope on one side of the hammer, a compression step formed on a lower side of the hammer nose such that the hammer nose is caught to compress the striking spring up to a predetermined position when the button is pushed, and a release step formed on an upper side of the hammer nose such that the slope of the hammer nose is pressed to cause the hammer nose to be separated from the compression step when the striking spring is compressed up to or past a predetermined length.

According to another aspect of the present invention, the compression step may be spaced apart from an end of the hammer nose by a predetermined length, which is set to a half or less of a length of a needle shank of a needle stored in the cartridge.

According to another aspect of the present invention, the acupuncture device body may include a locking switch for locking or unlocking the button.

In another exemplary embodiment of the present invention, there is provided a cartridge for a consecutive acupuncture device, in which a plurality of needles stored in the cartridge are sequentially loaded at a striking position of the consecutive acupuncture device. The cartridge comprises: a needle storage space in which at least one needle is stored; a charge slot serving as a passage for connecting the needle storage space with the striking position to enable sequential loading of the needles at the striking position; and a catch step formed on at least part of the charge slot in order to prevent the needle neighboring the loaded needle, which is loaded at the striking position and then is struck and administered, from being discharged with the loaded needle. At least part of the charge slot including an entrance of the charge slot into which the needle of the needle storage space enters may be formed such that opposite sides thereof are asymmetrical with respect to each other.

According to an aspect of the present invention, at least part of the charge slot including the entrance of the charge slot may be formed so as to have slopes with different inclined angles, different heights, or rounded faces with different curvatures.

According to another aspect of the present invention, the charge slot may include a discharge hole made up of an upper discharge hole and a lower discharge hole at opposite ends thereof. The lower discharge hole may have a major axis length that is 1.5 times greater than a diameter of a needle shank of the needle.

According to another aspect of the present invention, the charge slot may be bent or curved at a predetermined angle at a middle part thereof.

According to another aspect of the present invention, the cartridge may include an intermediate connecting member forming an upper part of the needle storage space and an upper part of the charge slot, a needle storage member forming a lower part of the needle storage space and a lower part of the charge slot, and a discharge member assembled to a lower end of the needle storage member and discharging the needle, wherein the three members are disconnected from each other.

According to another aspect of the present invention, the discharge member may include a guide hole for discharging the needle, into which a guide pipe is fitted so as to be able to move up and down. The guide pipe may protrude from the discharge member in a downward direction, and adjust a depth the needle is pierced into an affected part according to a protrusion length.

According to another aspect of the present invention, the discharge member may include a plurality of multistage slits in part of an outer circumference thereof which adjusts the protrusion length of the guide pipe in an alternate form. The guide pipe may include an adjustment pin on an outer circumference thereof which is caught in one of the multistage slits so as to fix the guide pipe.

According to another aspect of the present invention, the discharge member may include a flat pad on an upper end thereof which has a through-hole at a position corresponding to the guide hole so as to prevent the needles stored in the needle storage space from being dislocated in a downward direction of the discharge member.

According to another aspect of the present invention, the guide pipe may include a stopper pin fitted thereinto at a lower end thereof.

In another exemplary embodiment of the present invention, there is provided a cartridge for a consecutive acupuncture device, in which a plurality of needles stored in the cartridge are sequentially loaded at a striking position of the consecutive acupuncture device. The cartridge comprises: a charge slot serving as a passage such that the stored needles are simultaneously and sequentially fed to the striking position; a catch step formed on at least part of the charge slot in order to prevent the needle neighboring the needle loaded at the striking position, which is subsequently struck and administered, from being discharged along with it. The charge slot may include a discharge hole made up of an upper discharge hole and a lower discharge hole at opposite ends thereof, and the lower discharge hole may have a major axis length that is 1.5 times greater than a diameter of a shank of the needle.

According to an aspect of the present invention, the charge slot may be bent or curved at a predetermined angle at a middle part thereof.

According to another aspect of the present invention, the cartridge may include an intermediate connecting member forming an upper part of the needle storage space and an upper part of the charge slot, a needle storage member forming a lower part of the needle storage space and a lower part of the charge slot, and a discharge member assembled at a lower end of the needle storage member for discharging the needle, wherein the three members are disconnected from each other.

BEST MODE

Reference will now be made in greater detail to exemplary embodiments of the invention with reference to the accompanying drawings.

Figure 8:
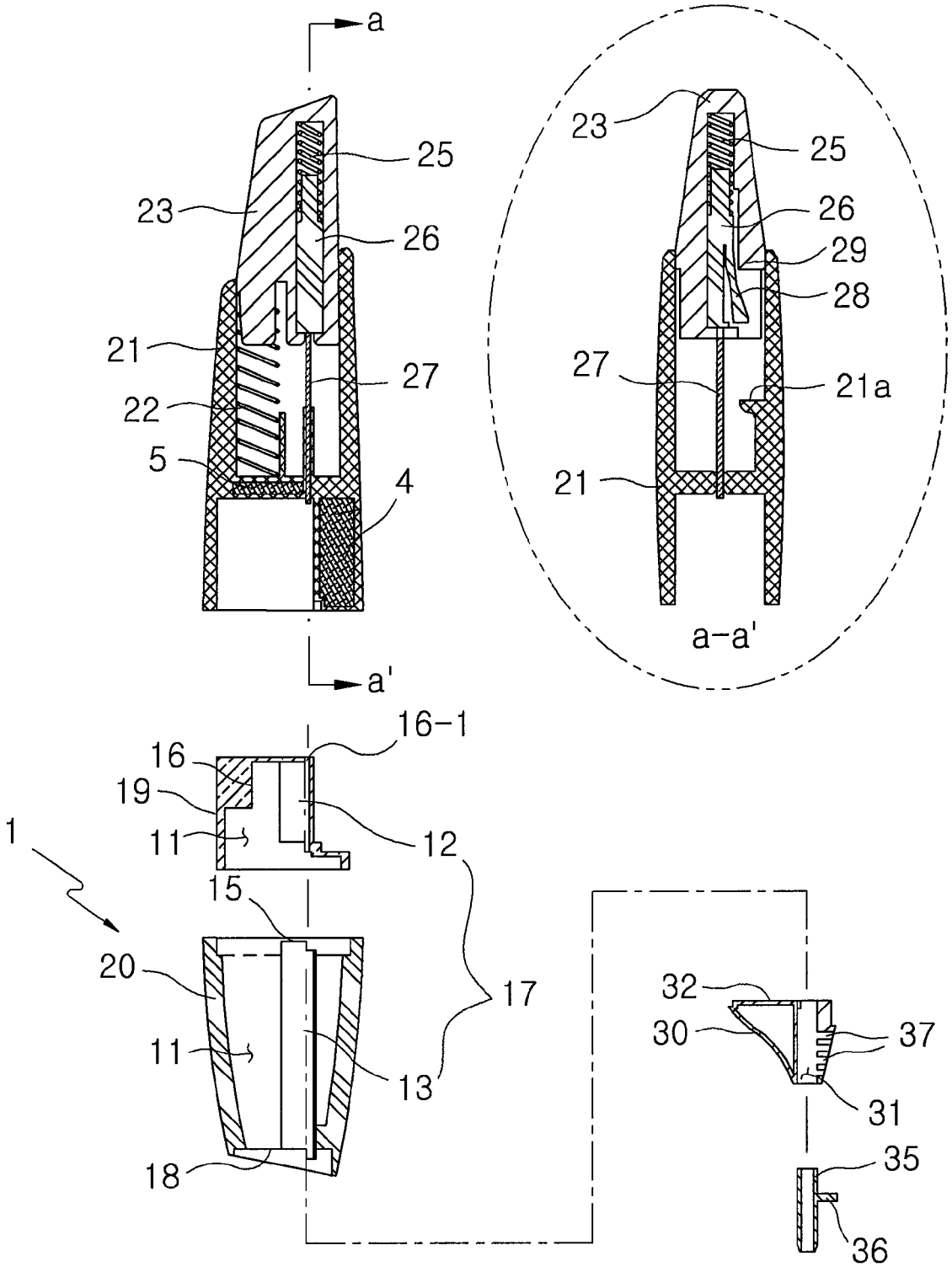
FIG. 8 is a disassembled side cross-sectional view illustrating a consecutive acupuncture device and a cartridge according to a first embodiment of the present invention.

According to a first embodiment of the present invention, as illustrated in FIG. 8, a consecutive acupuncture device on which a cartridge 1 is mounted includes a first magnet 4 and a second magnet 5, which are located on one side and an upper side of the cartridge 1 and cause the stored needle 10 to be attracted upwards and automatically loaded at a striking position by magnetic force, a striking means, which is located on the upper side of the cartridge 1 and strikes the needle located at the striking position so as to administer acupuncture into an acupuncture point, a button 23, which is installed on the upper side of the cartridge 1 so as to be elastically biased upwards by a return spring 22, a hammer 26, which is installed in the button 23 so as to be elastically biased downwards by a striking spring 25, a hammer nose 28, which is provided with a slope on one side of the hammer 26 in an upward direction, a compression step 21*a*, which is formed on a lower side of the hammer nose 28 such that the hammer nose is caught and the striking spring 25 is compressed up to a predetermined position when the button 23 is pushed, and a release step 29, which is formed on an upper side of the hammer nose such that when the slope of the hammer nose is pressed the hammer nose becomes separated from the compression step when the striking spring 25 is compressed up to or past a predetermined length.

Figure 9:
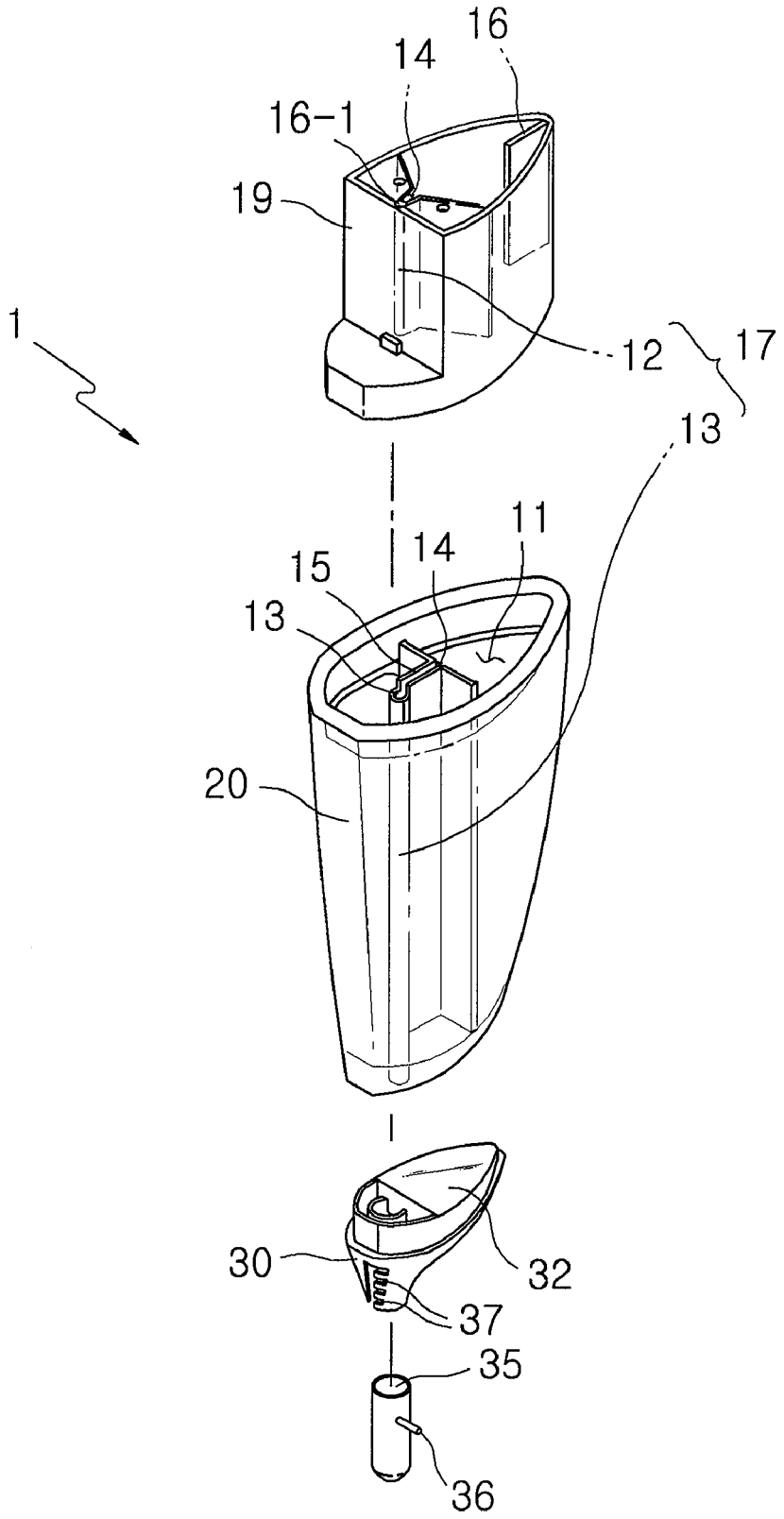
FIG. 9 is a disassembled perspective view illustrating a cartridge according to a first embodiment of the present invention.
Figure 10:
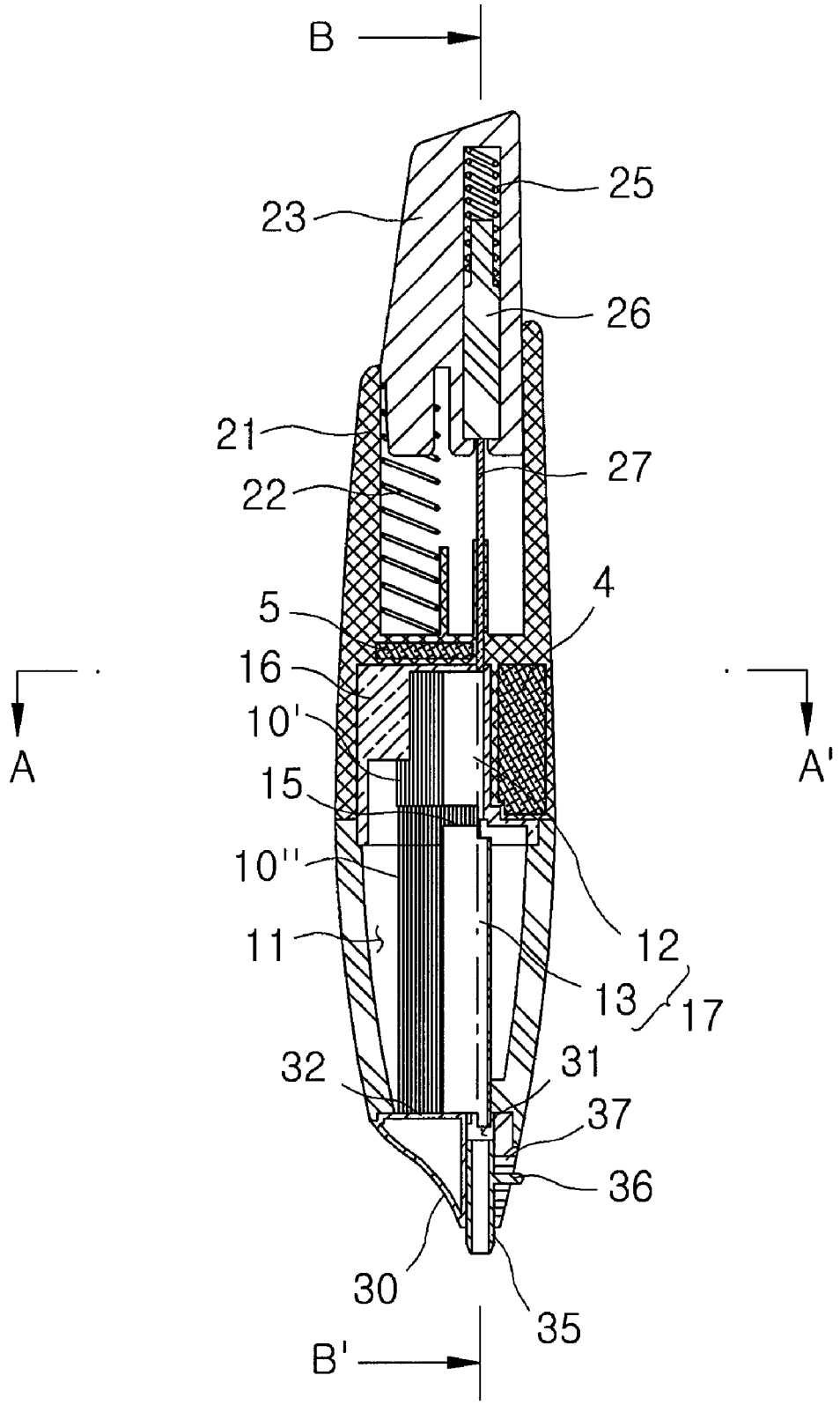
FIG. 10 is an assembled side cross-sectional view illustrating a consecutive acupuncture device and a cartridge according to a first embodiment of the present invention.

First, as illustrated in FIGS. 8 through 10, the cartridge 1 of the first embodiment includes an intermediate connecting member 19 forming the upper part of a needle storage space 11, a needle storage member 20 forming a lower part of the needle storage space 11, and a discharge member 30 through which a struck needle is discharged, wherein the three members can be disconnected from each other. However, it should be noted that the cartridge 1 of the first embodiment includes an integrated cartridge in which the intermediate connecting member 19, the needle storage member 20, and the discharge member 30 are integrally formed with each other.

The intermediate connecting member 19, the needle storage member 20, and the discharge member 30 are sequentially coupled to a housing having the striking means.

Figure 12:
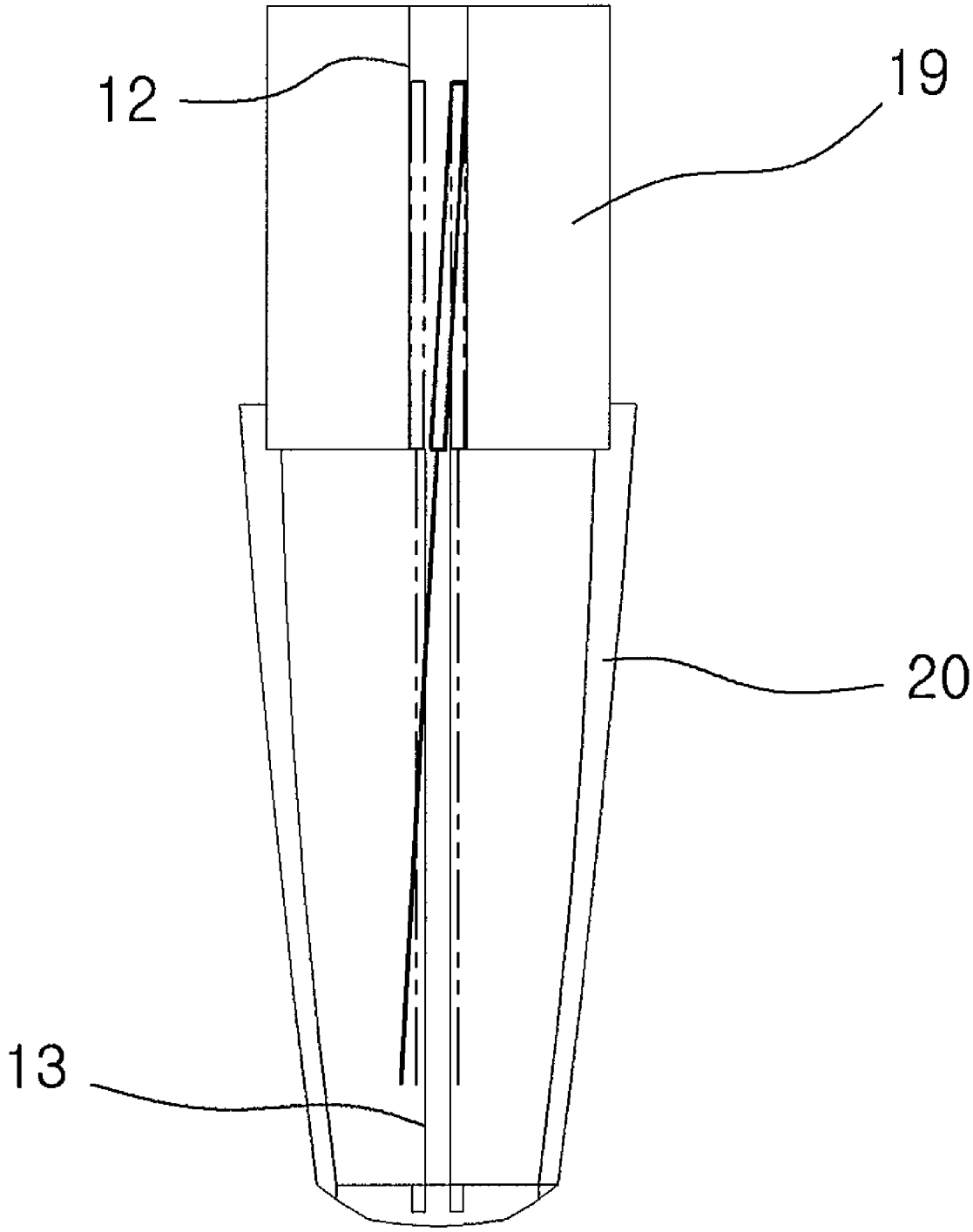
FIG. 12 is a cross-sectional view taken along line B-B' of FIG. 10.

Here, as illustrated in FIG. 9, when the intermediate connecting member 19 and the needle storage member 20 are joined together, the needle storage space 11 in which a plurality of needles are stored is defined on one side of the assembly. The needle storage space 11 is provided with a charge slot 14 on one side thereof which feeds the needles 10 arbitrarily stored to the striking position one by one. At this time, the charge slot 14 of the intermediate connecting member 19 located on an upper side of the assembly has a relatively wide part so as to pass needle shanks 10' of the stored needles 10, whereas the charge slot 14 of the needle storage member 20 located on a lower side of the assembly has a relatively narrow part so as to pass needle shanks 10' of the stored needles 10. Thus, the middle part of the charge slot 14, where the intermediate connecting member 19 is in contact with the needle storage member 20, is naturally provided with a catch step 15 in a direction in which the needles 10 enter into the charge slot. This catch step 15 serves to catch the needle shank 10' of the needle 10 neighboring on the struck needle 10 so as to prevent the neighboring needle 10 from being attracted downwards together with the struck needle 10 when the needle 10 located at the striking position is struck. As illustrated in FIG. 12, this configuration of the catch step 15 can be found through a width difference between a lower discharge hole 13 of the intermediate connecting member 19 and an upper discharge hole 12 of the needle storage member 20.

Figure 11:
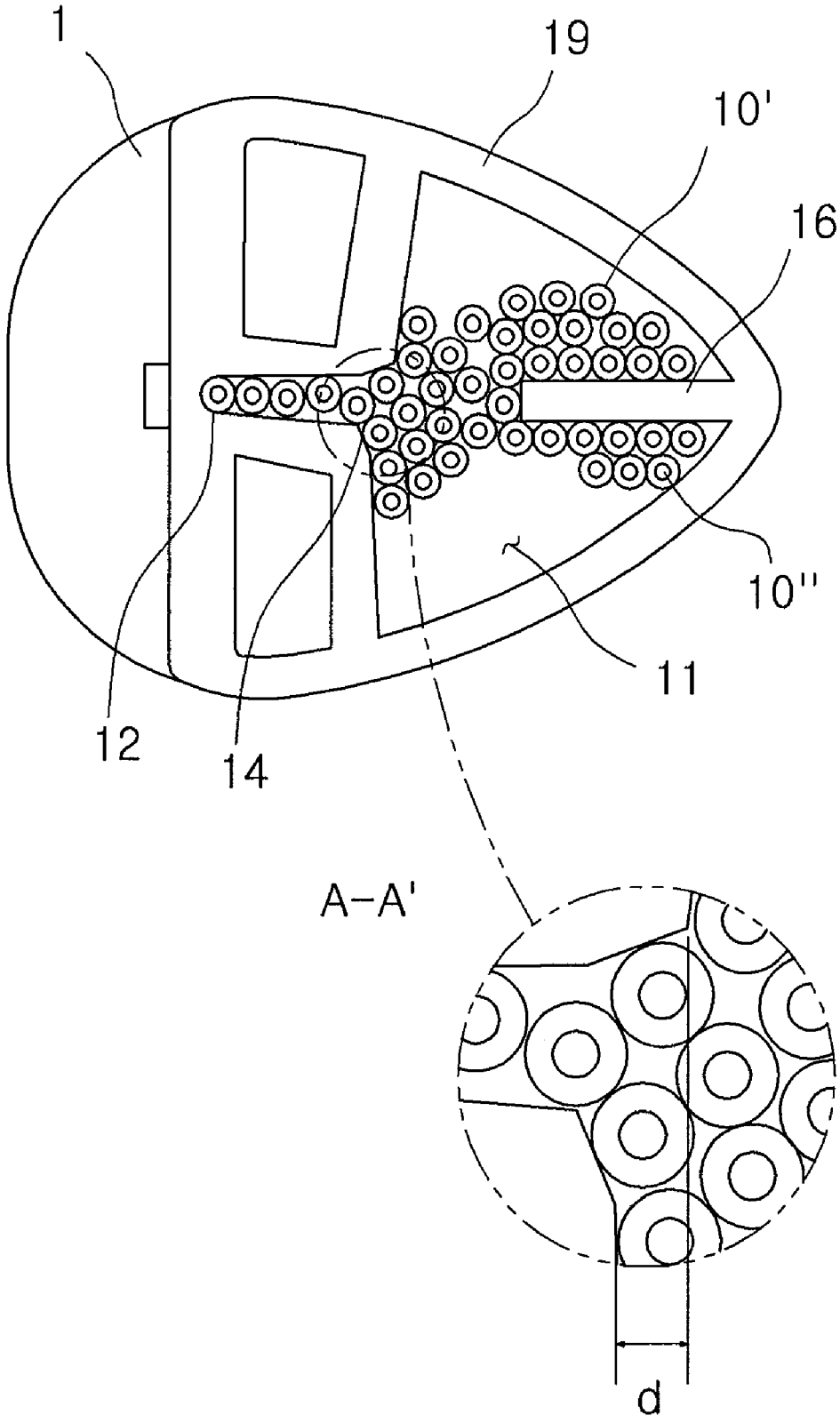
FIG. 11 is a cross-sectional view taken along line A-A' of FIG. 10.

As illustrated in FIG. 11, an entrance of the charge slot 14 which each needle 10 enters, has in particular a height difference d between opposite sides thereof.

Figure 13:
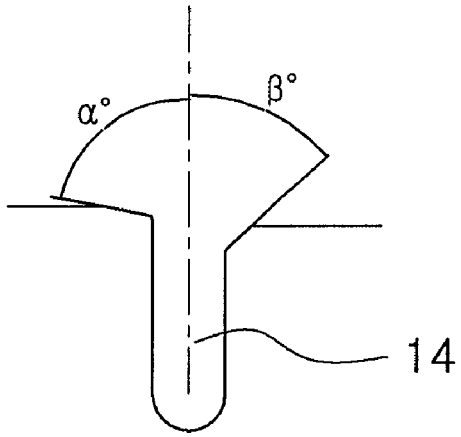
FIG. 13 is a view explaining an entrance formed in an intermediate connecting member of a charge slot in a consecutive acupuncture device according to a first embodiment of the present invention.
Figure 13:
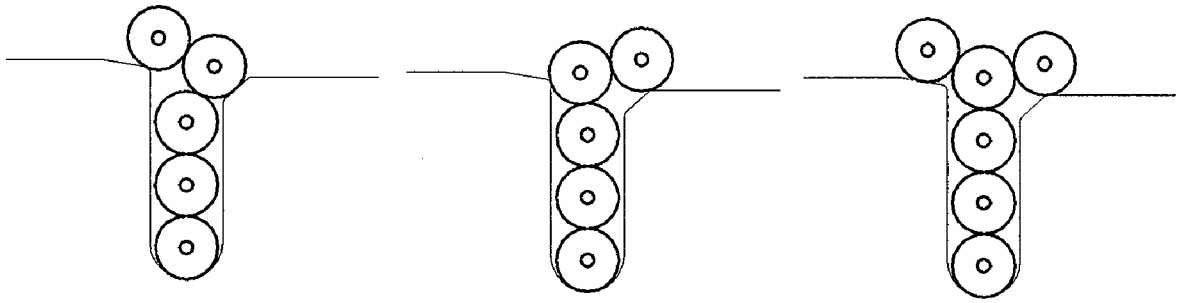

According to another embodiment, as illustrated in FIG. 13A, the entrance of the charge slot 14 has slopes on opposite sides thereof so as to have different inclined angles $\alpha°$ and $\beta°$.

In general, the needles 10 attracted to the striking position by the first magnet 4 fail to be loaded at the entrance of the charge slot 14 due to a bottleneck phenomenon. For this reason, the opposite sides of the entrance of the charge slot 14 are formed so as to have different heights or different slops with different inclined angles $\alpha°$ and $\beta°$. Thereby, as illustrated in FIG. 13B, the needles 10 are disposed in a zigzag fashion, so that they can avoid the bottleneck phenomenon, and thus prevent failure to load.

Although the first embodiment has been described regarding the height difference and the inclined angle, such a bottleneck phenomenon can also be avoided by rounding the opposite sides of the entrance of the charge slot 14 with different curvatures.

Figure 14:
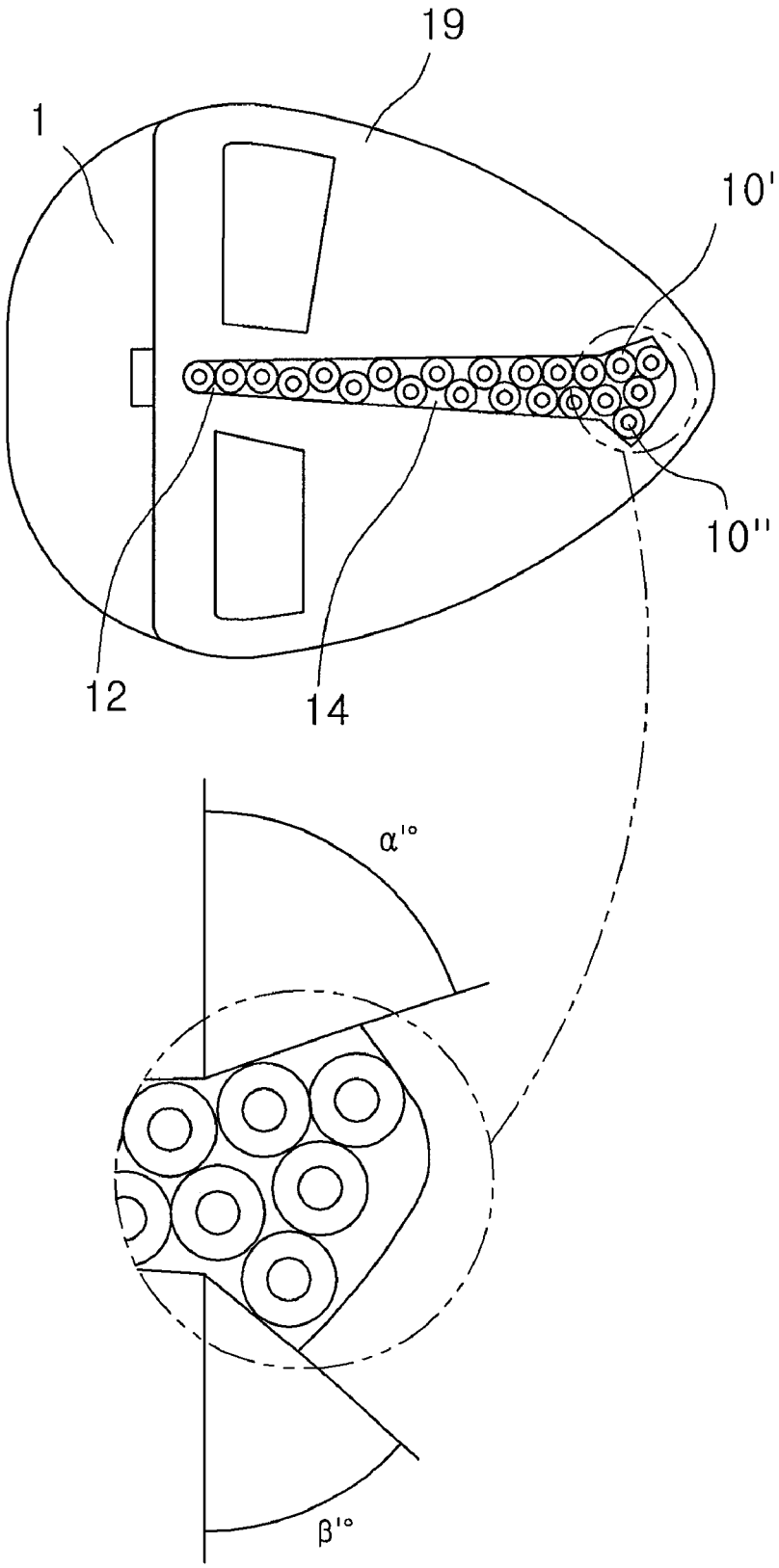
FIG. 14 illustrates another example of a cartridge mounted on a consecutive acupuncture device according to a first embodiment of the present invention.

Meanwhile, as illustrated in FIG. 14, the first embodiment may be designed so that the charge slot serves as a passage such that the needles are stored and sequentially fed to the striking position without requiring a separate needle storage space, and so that the charge slot has a catch step on at least one part thereof so as to prevent the neighboring needle from being discharged together when the needle loaded at the striking position is struck and ejected. In this manner, in the case in which only the charge slot is formed without the needle storage space, the opposite sides of the entrance of the charge slot 14 have slopes with different inclined angles $\alpha'^{\circ}$ and $\beta'^{\circ}$, different heights, and rounded faces with different curvatures as illustrated in FIG. 14, so that the bottleneck phenomenon can be avoided.

As illustrated in FIG. 11, the intermediate connecting member 19 is provided with a partition 16 protruding toward the charge slot 14 on the opposite side of the charge slot 14. This partition 16 is aligned with the charge slot 14 in a line, and thus supports the stored needles 10 so as to be aligned with charge slot 14 and to be able the needles to smoothly enter into the charge slot 14. Further, the partition 16 serves to partition the needle storage space 11 such that the stored needles 10 are prevented from severe movements of position inside the needle storage space 11 although an acupuncture angle be frequently varied in direction.

In addition, the intermediate connecting member 19 has the upper discharge hole 12 at the striking position of one end of the charge slot 14. An upper end of the upper discharge hole 12 serves as a hammer hole 16-1 such that the hammer plunger 27 of the hammer 26 of the consecutive acupuncture device can strike each needle 10. Further, the needle storage member 20 has the lower discharge hole 13 connected with the upper discharge hole 12 at the striking position of one end of the charge slot 14. Thereby, the upper discharge hole 12 and the lower discharge hole 13 are formed into an in-line discharge hole 17.

At this time, the discharge hole 17 is preferably shaped of a funnel in which the lower discharge hole 13 located under the catch step 15 is larger than the upper discharge hole 12 located on the catch step 15, so that one struck needle 10 can be smoothly discharged, and so that the lower discharge hole 13 formed in the needle storage can avoid interference with the neighboring needle when the struck needle 10 is discharged and induce insertion of the struck needle into a correct position when acupuncture is being administered.

At this time, the lower discharge hole 13 has a major axis length that is 1.5 times greater than a diameter of the shank of the needle. This is intended to allow the struck needle to be smoothly discharged. In detail, when a first needle loaded at the striking position is struck and then a second needle located neighboring the first needle is loaded at the striking position, a shank of the first needle that has been struck does not push a body of the second needle. As a result, the struck needle is smoothly discharged when the second needle is attracted upwards.

The first magnet 4 and the second magnet 5 are installed inside the housing 21 of the consecutive acupuncture device on which the cartridge 1 of the first embodiment is mounted so as to be located on one side and on the upper side of the intermediate connecting member 19, respectively. The first magnet 4 is located adjacent to the upper discharge hole 12 of the intermediate connecting member 19, and automatically loads each needle 10 stored in the needle storage space 11 at the striking position by attracting each needle 10 along the charging slot 14. The second magnet 5 is located on the upper side of the intermediate connecting member 19, and attracts the needles 10 in an upward direction by means of its magnetic force, thereby preventing a tip of the needle body 10" of each needle 10 from becoming damaged.

Further, the needle storage member 20 is provided with a needle charge opening 18 at a lower end of the needle storage space 11 thereof. The needles 10 that are sterilized can be directly charged from a bag, without touching the shanks 10' of the needles 10, through the needle charge opening 18 once. The needle charge opening 18 is detachably coupled with the discharge member 30, through which the struck needle 10 is finally discharged. Here, the discharge member 30 is provided with a flat pad 32 on an upper end thereof which supports the needles 10 stored in the needle storage space 11 such that the needles 10 are not dislocated from designated positions in a downward direction. In detail, the needles 10 stored in the needle storage space 11 are attracted upwards by the second magnet 5 disposed on the upper side of the intermediate connecting member 19. In this state, when a striking force is accumulated by external impact or consecutive acupuncture while being in use, some of the needles 10 may be dislocated from upwardly attracted positions in a downward direction. At this time, the flat pad 32 of the discharge member 30 supports the needles 10 to prevent the needles 10 from moving downwards.

Figure 15:
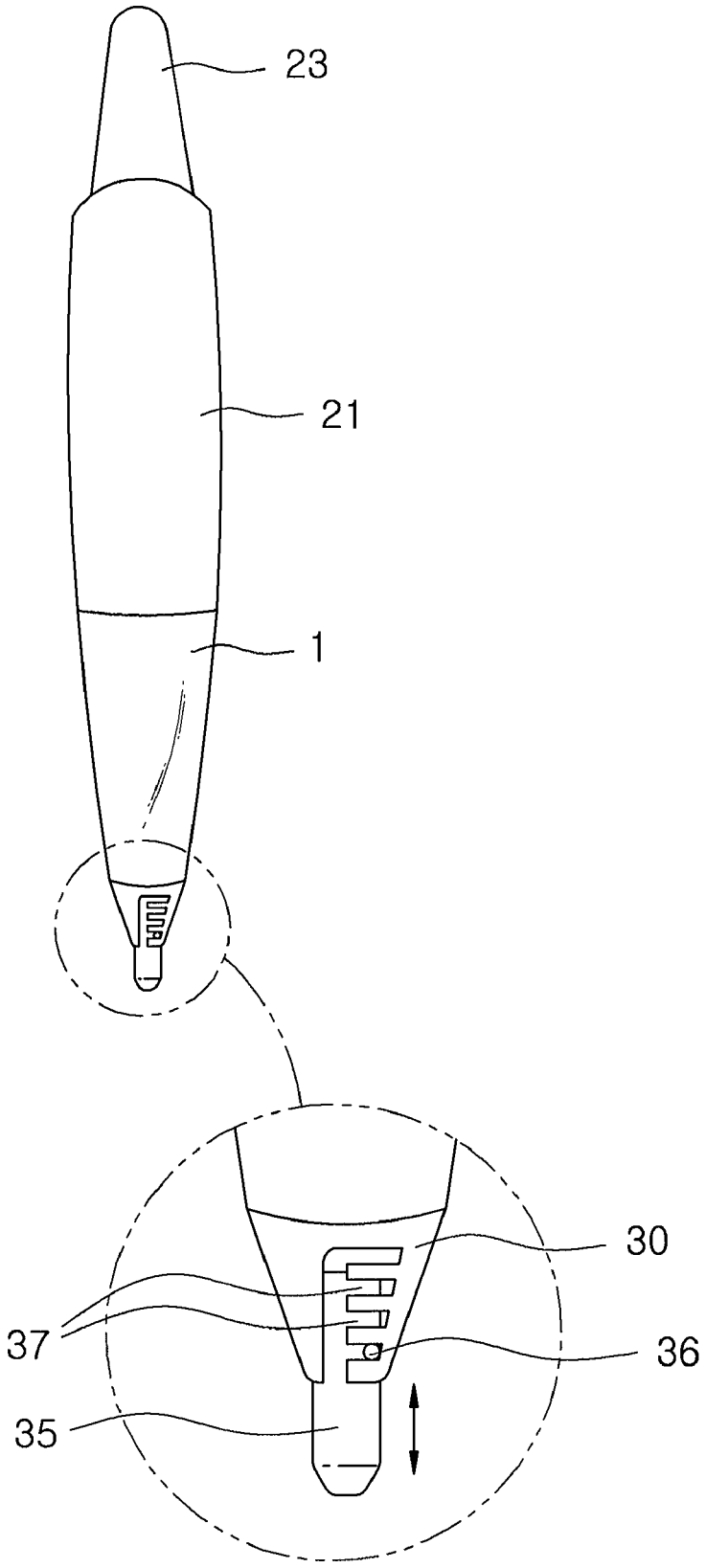
FIG. 15 illustrates the operation of a guide pipe in a cartridge according to a first embodiment of the present invention.

As illustrated in FIG. 15, the discharge member 30 is provided with a hole 31 in a direction in which the needle 10 is struck. A guide pipe 35 discharging the struck needle 10 is movably installed in the hole 31 in a lengthwise direction. Further, the discharge member 30 is provided with a plurality of multistage slits 37 in one sidewall thereof which is spaced apart from each other at regular intervals in a direction where the needle 10 is discharged so as to communicate with the hole 31. The guide pipe 35 is provided with an adjustment pin 36 on an outer surface thereof which is caught in one of the multistage slits 37 so as to adjust a protrusion length of the guide pipe 35, so that a piercing depth of the needle 10 can be adjusted during the administration of acupuncture.

Although the first embodiment has been described regarding a refill type cartridge in which the needle charge opening 18 of the needle storage member 20 is opened or closed by the discharge member, a disposable cartridge that is disposed of when all the stored needles 10 have been used may be used instead of the integrated cartridge 1 in which the needle storage member 20 and the discharge member 30 are assembled with each other so as to refill the needles 10.

An operation mechanism of the first exemplary embodiment having the aforementioned configuration will be described with reference to FIGS. 8 through 10.

The consecutive acupuncture device is assembled by arbitrarily charging the sterilized needles 10 into the cartridge 1, coupling the discharge member 30 having the flat pad 32 to the needle charge opening 18 of the cartridge 1 in order to close the needle charge opening 18, and coupling the striking means to the upper side of the cartridge 1.

In this state, when the operator puts the guide pipe 35 of the discharge member 30 to the affected part of the human body, and pushes the button 23 so as to move the button 23 in a downward direction at a predetermined length, the hammer nose 28 housed in the button 23 is caught on the compression step 21*a*, and thereby the striking spring 25 elastically supporting the hammer 26 is compressed. Then, when the button 23 is further lowered to a predetermined depth, the inclined face of the hammer nose 28 is pressed by the release step 29, and thus the hammer nose 28 is released from the compression step 21*a*. As a result, the hammer 26 is launched by the elastic force of the striking spring 25, and thus momentarily strikes one needle 10 located at the striking position.

In this process, as illustrated in FIG. 11, the cartridge 1 according to the first embodiment of the present invention allows the needles 10 stored in the needle storage space 11 to be supported in alignment with the charge slot 14 in a line so as to smoothly enter into the charge slot 14 by virtue of the partition 16 protruding toward the charge slot 14 in a line on the opposite side of the charge slot 14 of the needle storage space 11, and is able to prevent the alignment of the needles 10 from being disrupted by inhibiting movement of the stored needles 10 when the acupuncture angle is changed.

Further, although at least one of the needles 10 stored in the needle storage space 11 is dislocated downwards from the position where the needles 10 are attracted upwards by the second magnet 5 by striking force or external impact, the flat pad 32 of the discharge member 30, which is installed under the needle storage space 11, supports the needles 10 so as to prevent the shank 10' of each needle 10 from being dislocated below the catch step 15 of the charge slot 14. Thus, since at least one of the needles 10 is not dislocated although the accumulation of the striking force or the transmission of the external impact is generated through the consecutive administration of acupuncture, the cartridge 1 according to the first embodiment of the present invention can prevent the malfunction of the needles 10 by catching the shank 10' of each needle 10 on the catch step 15 of the charge slot 14, so that the consumer can use the consecutive acupuncture device without anxiety, and thus the reliability of the consecutive acupuncture device can be greatly improved.

According to a second embodiment of the present invention, first, the basic configuration of the consecutive acupuncture device on which the cartridge is mounted is identical to that of the consecutive acupuncture device of the first embodiment, and so the description thereof will be omitted.

Figure 16:
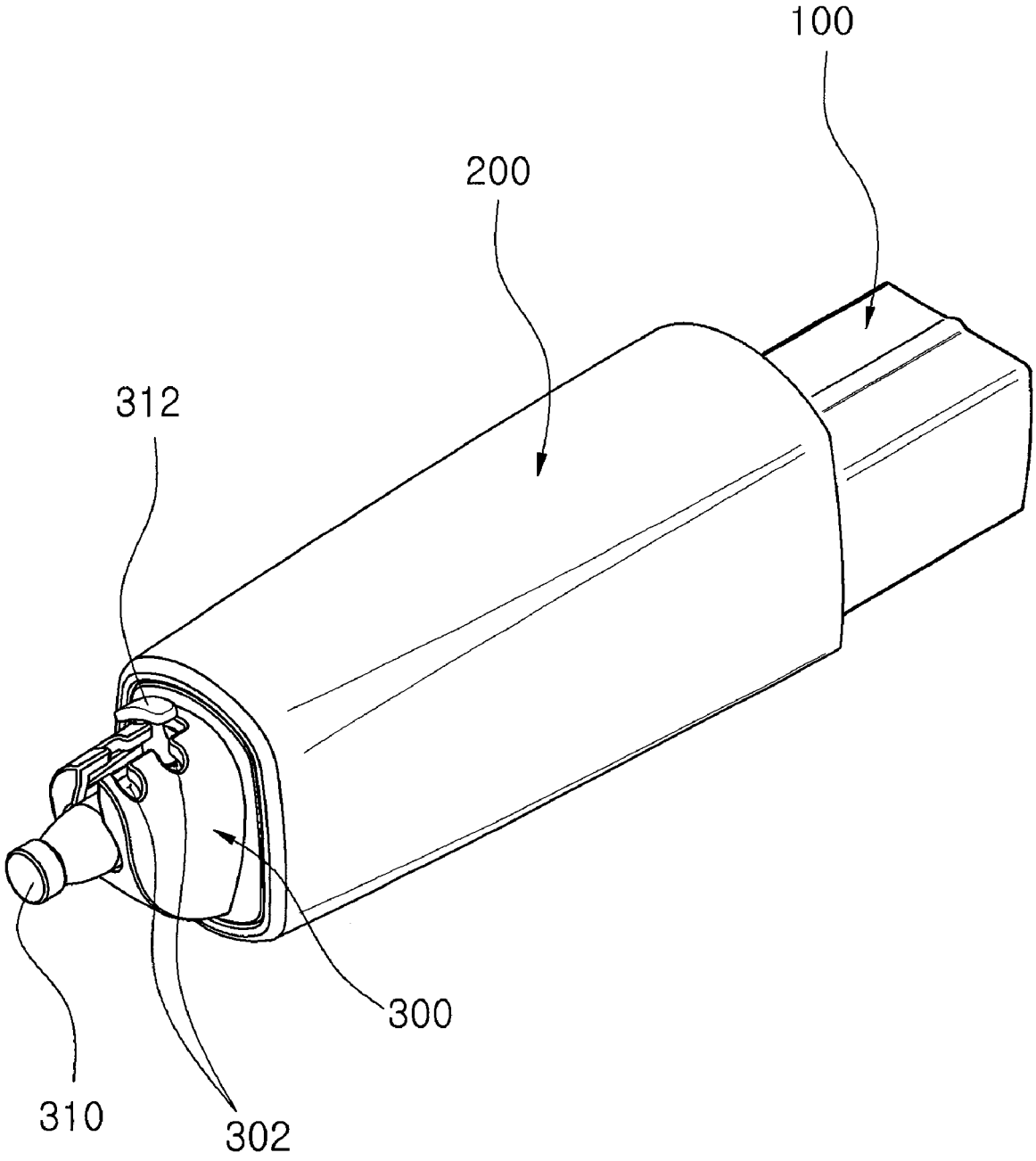
FIG. 16 is an entire perspective view illustrating a cartridge according to a second embodiment of the present invention.
Figure 17:
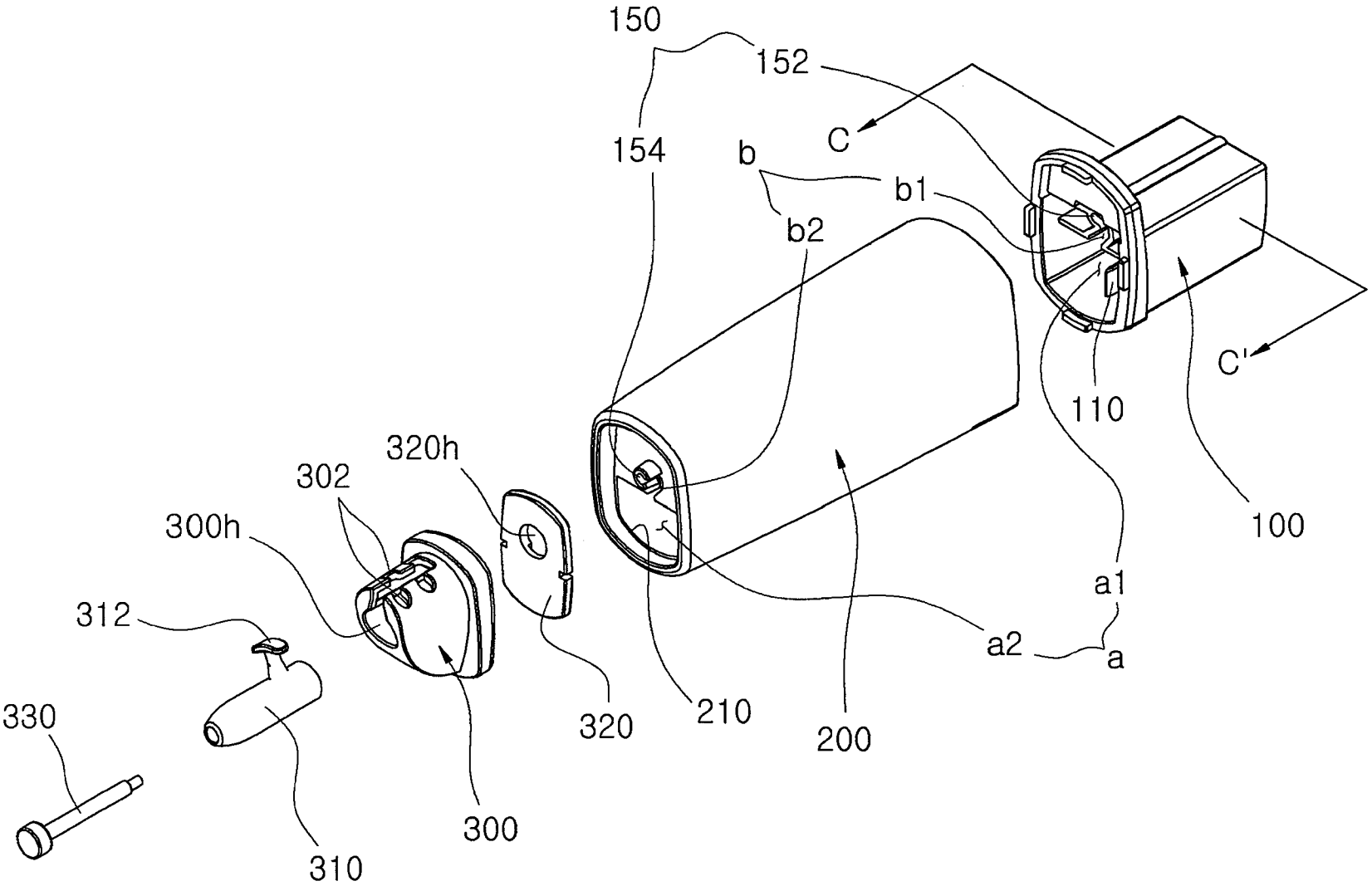
FIG. 17 is a disassembled perspective view illustrating a cartridge according to a second embodiment of the present invention.

As illustrated in FIGS. 16 and 17, the cartridge of the consecutive acupuncture device of the second embodiment generally includes an intermediate connecting member 100, a needle storage member 200, and a discharge member 300, which are detachably coupled with each other. The intermediate connecting member 100 is configured to simultaneously form the upper part a1 of a needle storage space a and the upper part b1 of a charge slot b. The needle storage member 200 is configured to simultaneously form a lower part a2 of the needle storage space a and a lower part b2 of the charge slot b so as to be assembled to a lower end of the intermediate connecting member 100. The discharge member 300 is assembled at a lower end of the needle storage member 200 so as to discharge the needles 10. Of course, it is apparent that the cartridge of the second embodiment includes an integrated cartridge in which the intermediate connecting member 100, the needle storage member 200, and the discharge member 300 are integrally formed with each other.

Figure 18:
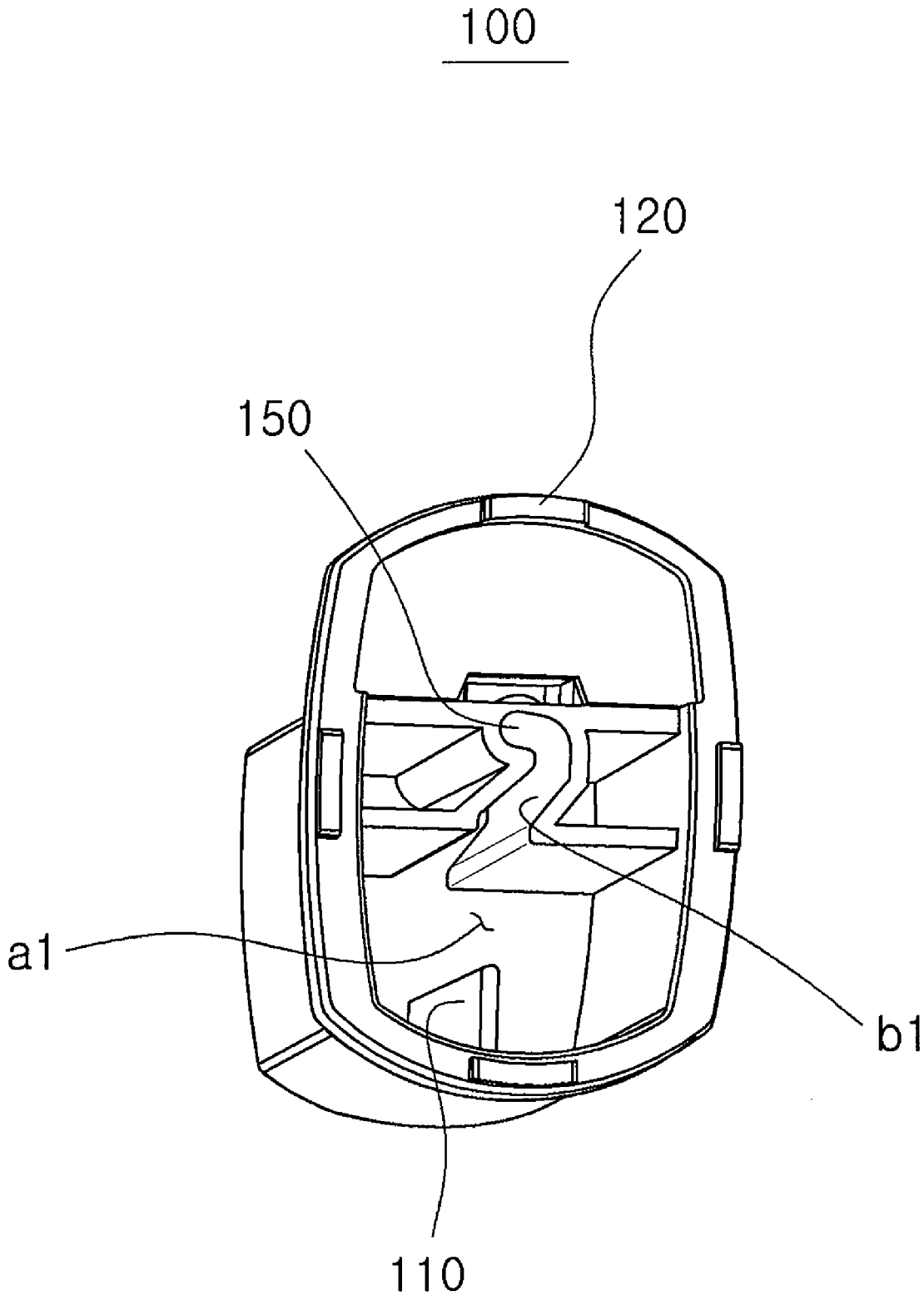
FIG. 18 is a perspective view illustrating an intermediate connecting member of a cartridge according to a second embodiment of the present invention.

As illustrated in FIG. 18, the intermediate connecting member 100 simultaneously forms the upper part a1 of the needle storage space a and the upper part b1 of the charge slot b. The shanks 10' of the needles 10 that are randomly stored are located in the intermediate connecting member 100.

In this manner, the needles 10, which are arbitrarily stored in the intermediate connecting member 100, are loaded at a striking position of a hammer plunger 6 by a first magnet 4.

At this time, the charge slot b functions as a passage that connects the needle storage space a with the striking position. In order to sequentially load the needles 10 stored in the needle storage space a at the striking position of the hammer plunger 6, a middle part of the charge slot b is bent or curved at a predetermined angle. When the hammer plunger 6 is returned, a phenomenon that the shanks 10' of the needles 10 are pushed toward the outside of the charge slot b can be remarkably reduced by the bent or curved middle part of the charge slot b. Thus, a phenomenon of the shanks 10' of the needles 10 becoming crossed in an X shape at an entrance of the charge slot and thereby blocking the entrance of the charge slot is prevented. In detail, the charge slot b, through which the needles 10 randomly stored in the needle storage space a are loaded, is formed so as to have a cross section that is bent at a predetermined angle with respect to a direction in which magnetic force is applied to the needles 10 in order to sequentially load the needles 10 of the needle storage space a at the striking position. In other words, as illustrated in FIG. 18, the bent charge slot b, particularly the upper part b1 of the charge slot b, is formed.

As described above, the configuration in which the upper part b1 of the charge slot b is bent is intended to solve a conventional problem in that the needles 10 are crossed in the X shape and thereby block the entrance of the charge slot b to cause malfunction. This configuration will be described below with reference to FIG. 21.

Figure 1:
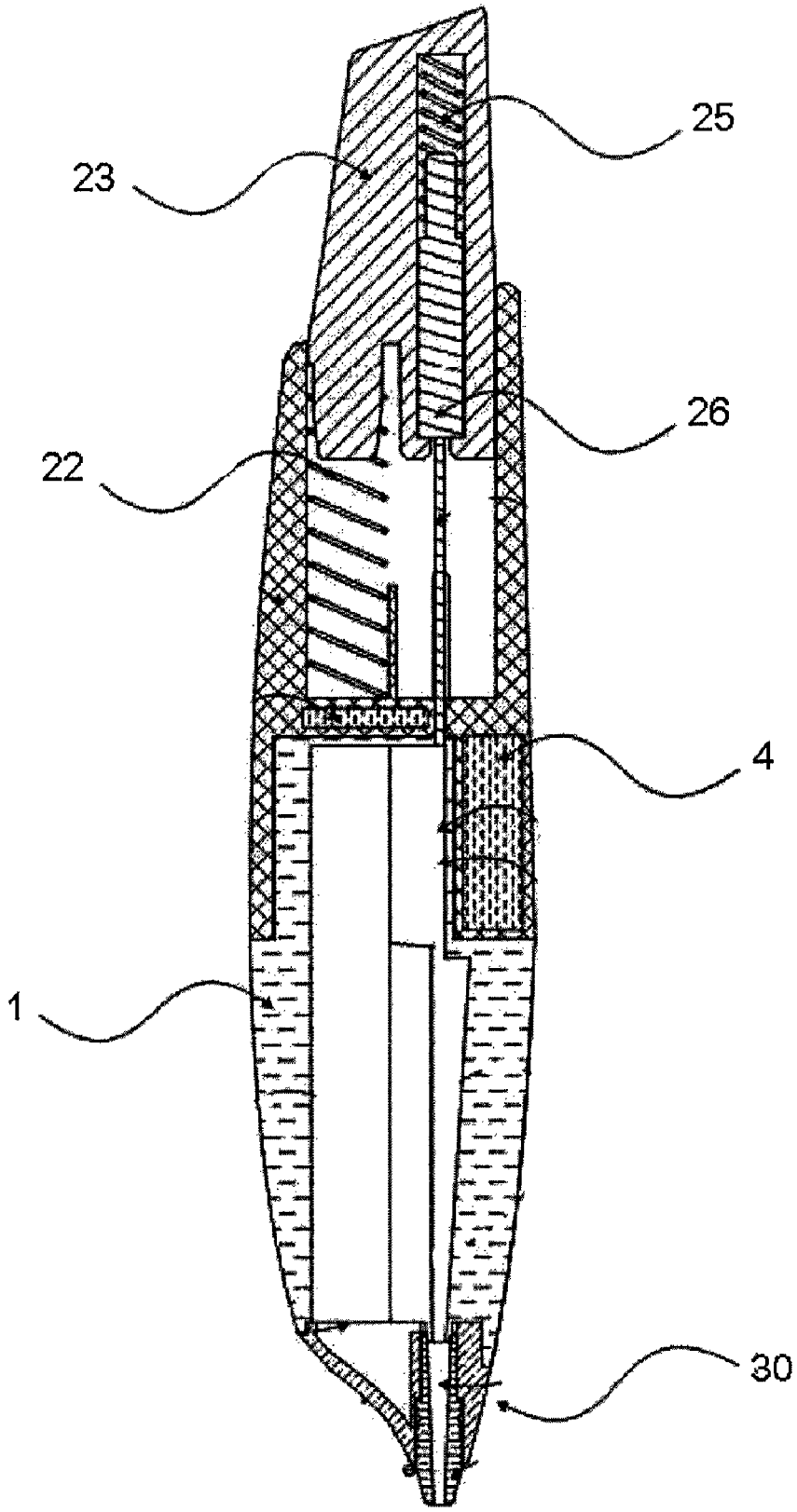
FIG. 1 is a cross-sectional view illustrating a conventional consecutive acupuncture device.
Figure 2:
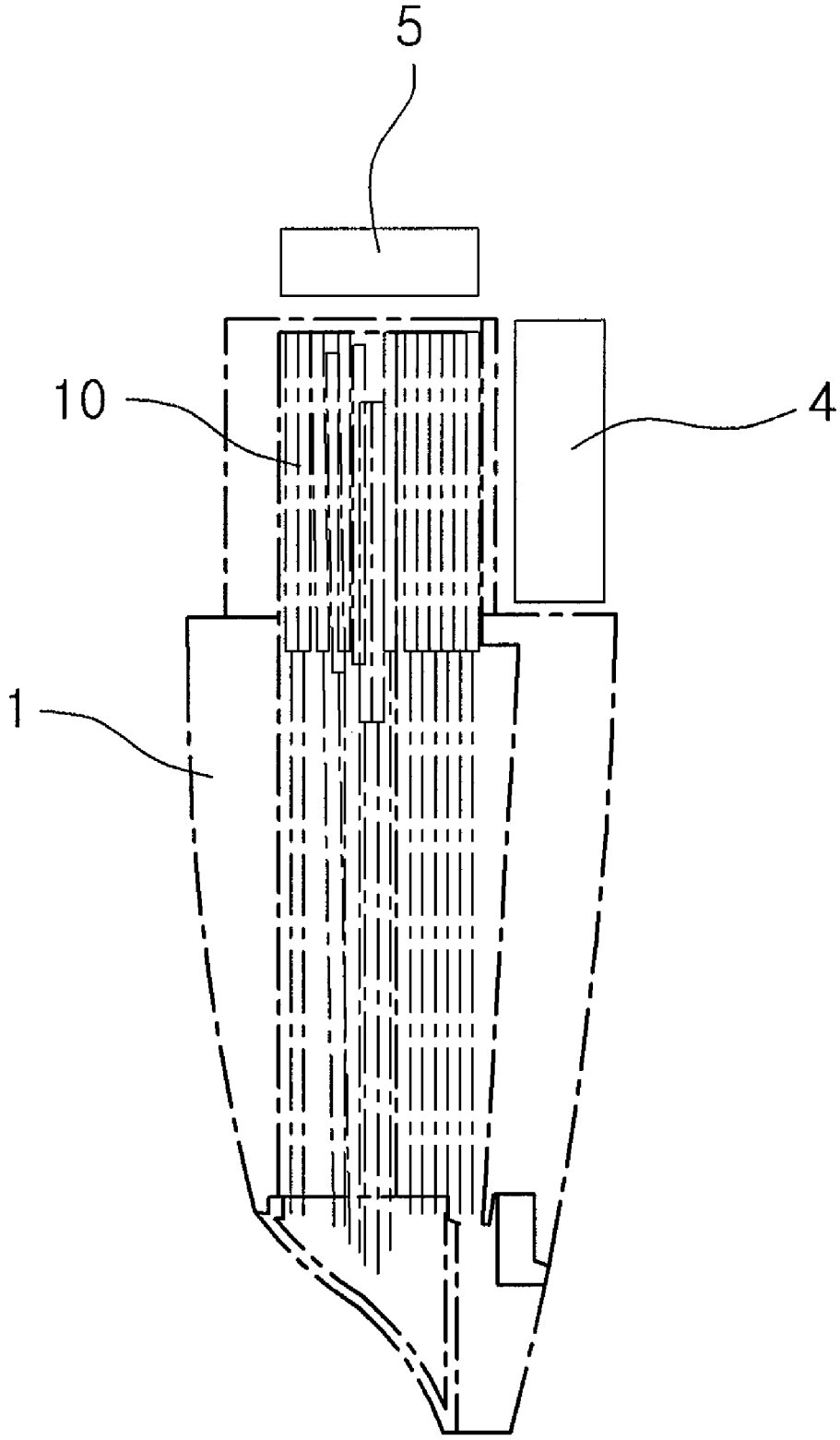
FIG. 2 is a cross-sectional view illustrating a cartridge for a conventional consecutive acupuncture device.
Figure 3:
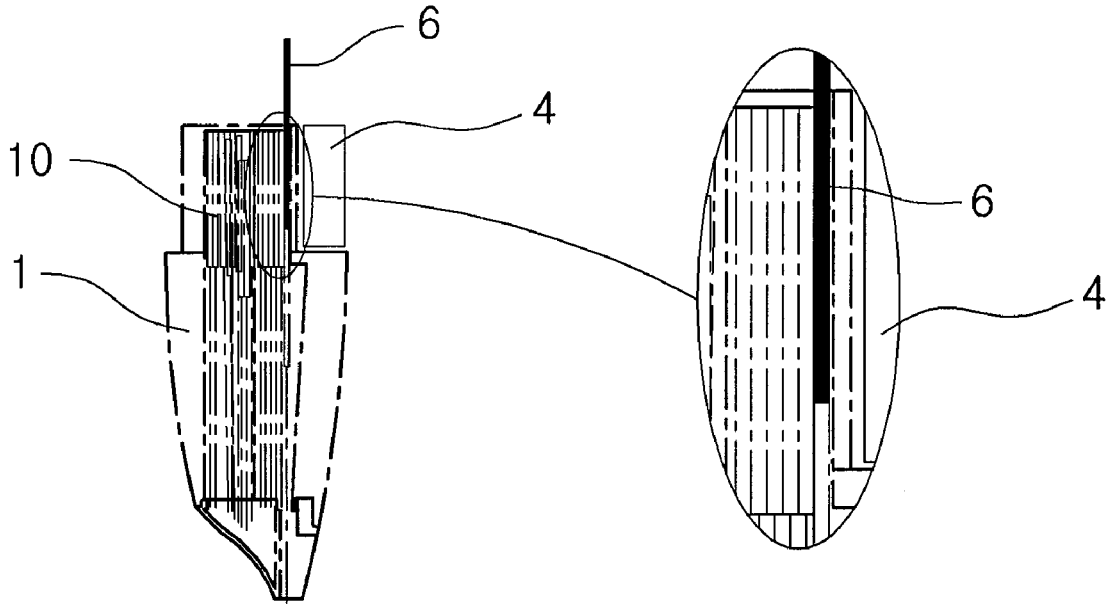
FIGS. 3 and 4 are cross-sectional views explaining a malfunction attributable to a hammer plunger in a cartridge for a conventional consecutive acupuncture device.
Figure 4:
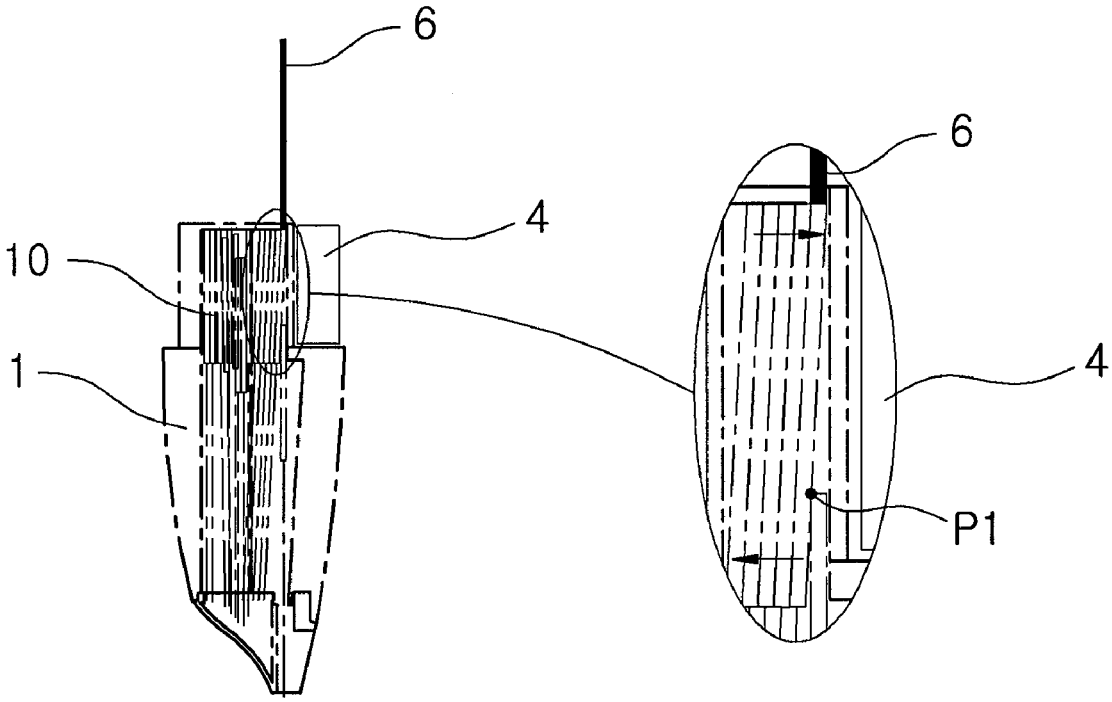
Figure 5:
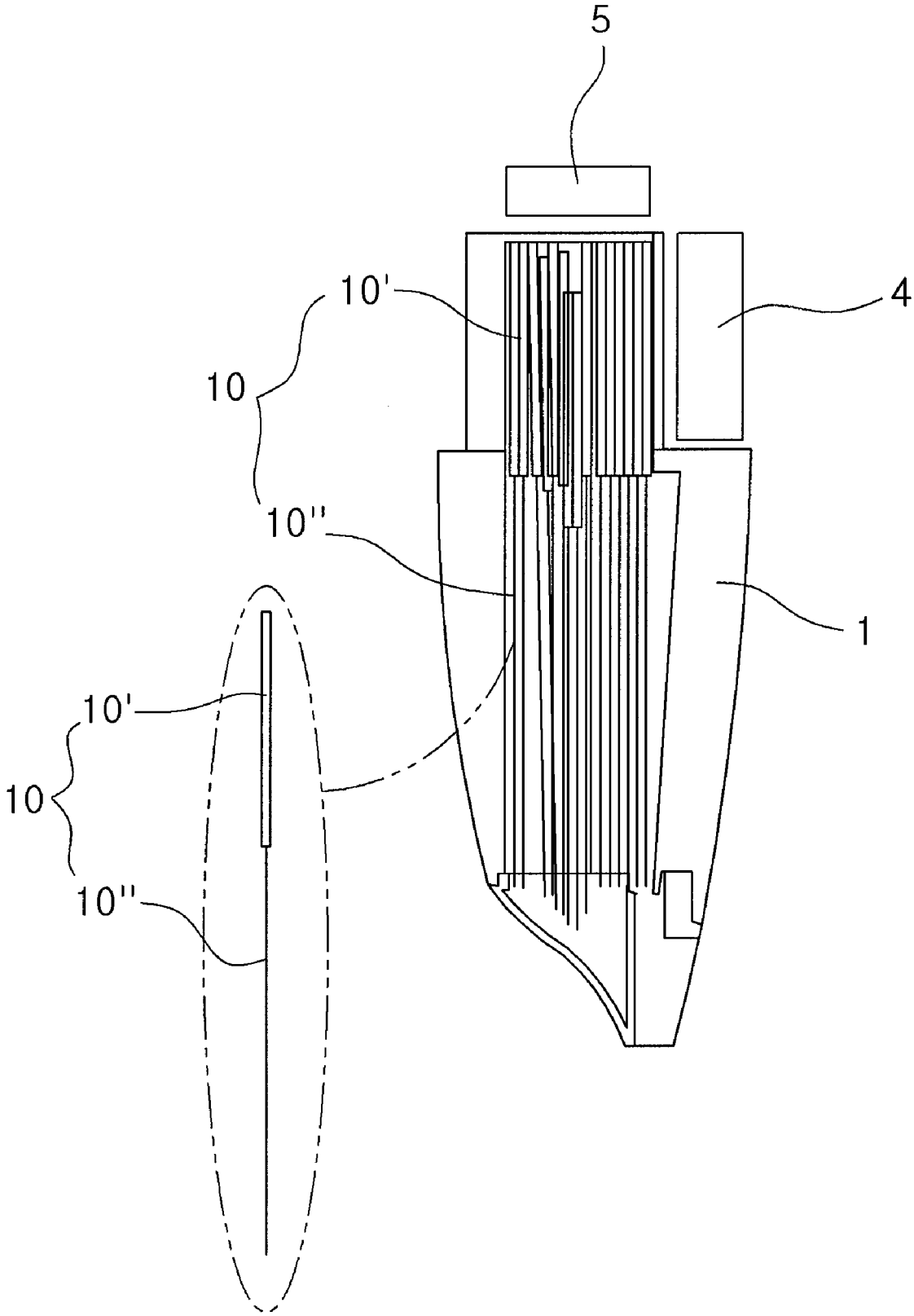
FIG. 5 is a cross-sectional view illustrating a cartridge for a conventional consecutive acupuncture device.
Figure 6:
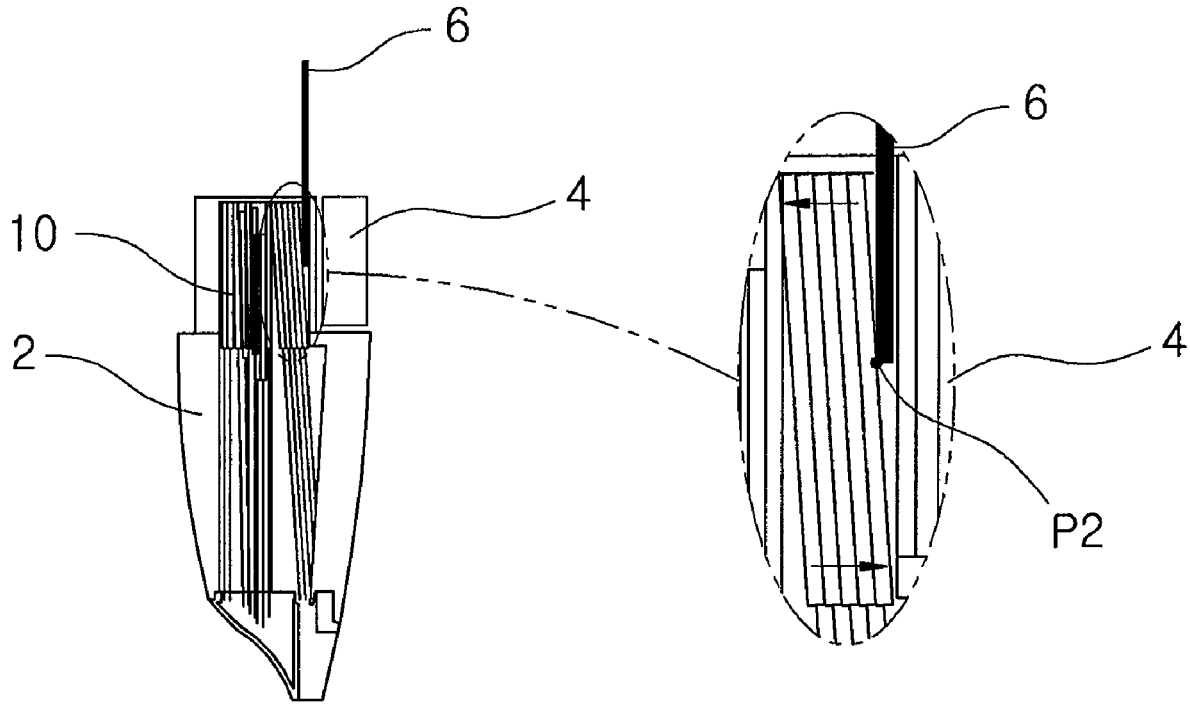
FIGS. 6 and 7 are cross-sectional views explaining a malfunction attributable to a hammer plunger in a cartridge for a conventional consecutive acupuncture device.
Figure 21:
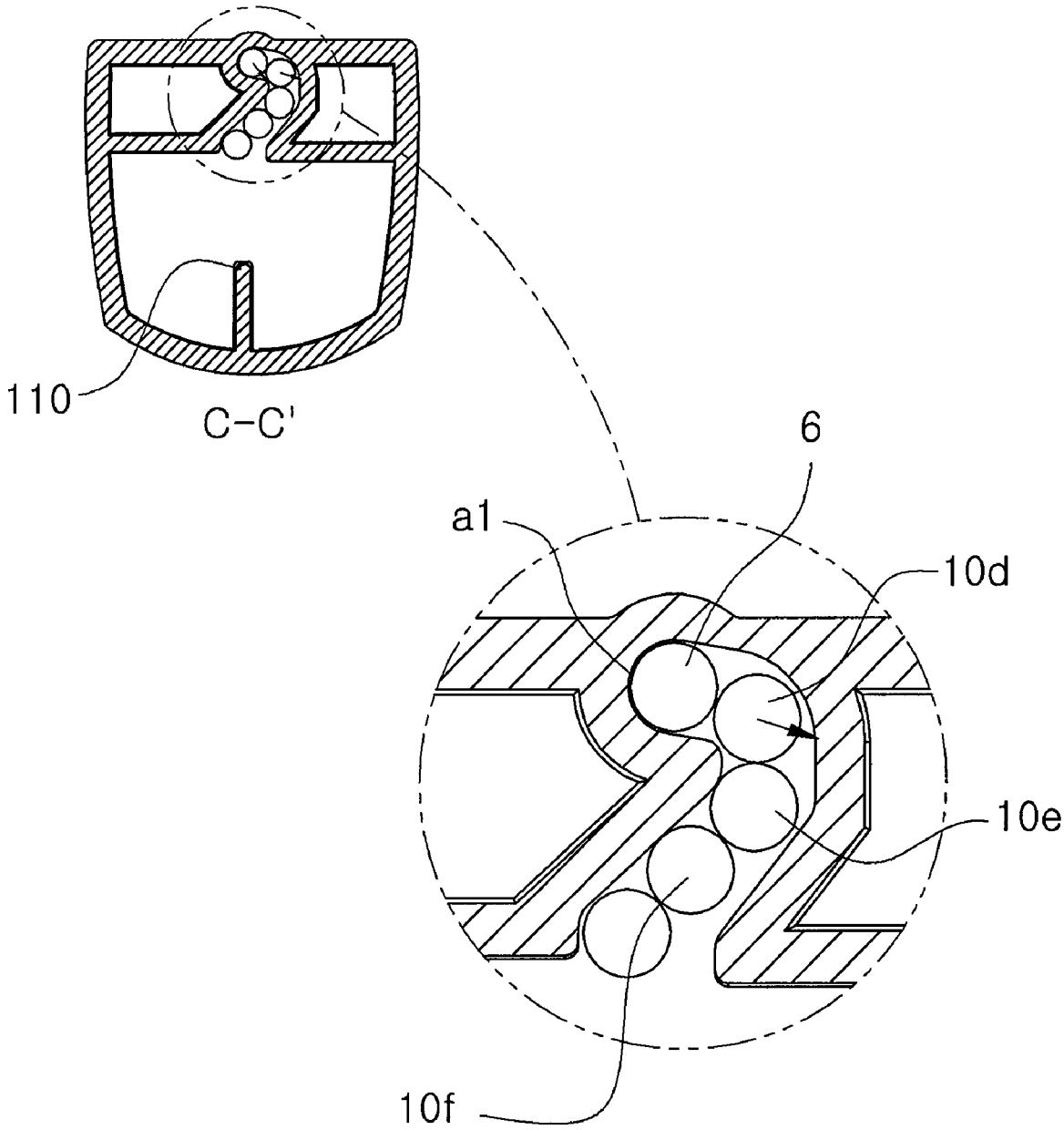
FIG. 21 is a cross-sectional view taken along line C-C' of FIG. 17.

As illustrated in FIG. 6, in a conventional cartridge, in the process in which the hammer plunger 6 strikes the loaded needle 10 and then stored returns to its original position, when one point P2 of the lower end of the hammer plunger 6 is located at a middle part of the shank 10' of each needle 10, a lower end of the needle shank 10' is attracted toward the inside of the charge slot b by the magnetic force, and an upper end of the needle shank 10' is pushed toward the outside of the charge slot b. However, as illustrated in FIGS. 18 and 21, in the cartridge of the second embodiment, the upper part b1 of the charge slot b is bent, and thus the upper part of the shank 10' of the first needle 10*d* is pushed in the direction of the arrow, i.e. in a lateral direction, that is not directed to the entrance of the charge slot b. As such, a driving force by which the upper ends of the needle shanks 10 of the subsequent incoming needles 10*e* and 10*f* are pushed towards the entrance of the charge slot b is weak. Thus, as in the related art, the phenomenon of the needles becoming entangled in the X shape at the entrance of the charge slot b and thereby blocking the entrance of the charge slot b does not occur. In other words, although the force intended to move to one side occurs, the direction in which the upper part of the needle shank 10' of the first needle 10*d* moves is the direction of the arrow, because of the bent shape of the charge slot b.

Figure 7:
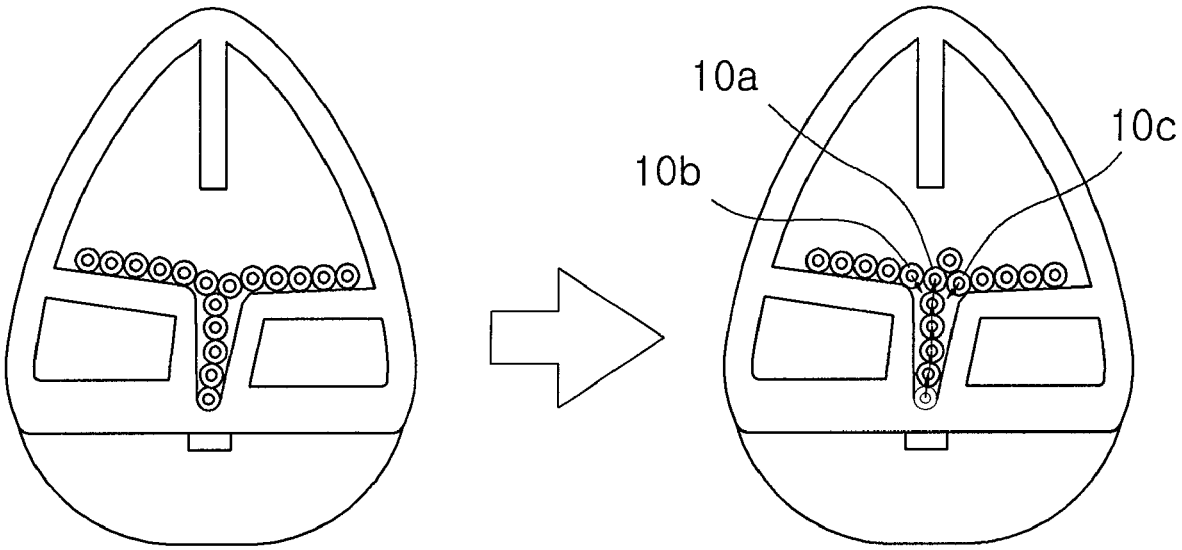

Consequently, when compared with the conventional cartridge, in the cartridge of the second embodiment, the upper part of the shank 10' of the needle 10*f* is pushed to the level remarkably lower than the level to which the needle 10*a* of FIG. 7 is pushed, and thus the malfunction of the needles, which are entangled in the X shape and therefore block the entrance of the charge slot b, can be prevented.

Meanwhile, the intermediate connecting member 100 is provided with a partition 110 protruding toward the charge slot b on the opposite side of the upper part b1 of the charge slot b. This partition 110 supports the stored needles 10 so as to be aligned with charge slot b and thus enables the needles 10 to smoothly enter into the charge slot b. Further, the partition 110 serves to partition the needle storage space a such that the stored needles 10 are prevented from large changes in position in the needle storage space a although an acupuncture angle be frequently changed in various directions.

In addition, the intermediate connecting member 110 is provided with an upper discharge hole 152 at a striking position of the hammer plunger 6 which is located at one end of the charge slot b. An upper end of the upper discharge hole 152 is provided with a hammer hole (not shown) passing through an upper surface of the intermediate connecting member 100 such that the hammer plunger 6 of the consecutive acupuncture device can strike each needle 10. The upper discharge hole 152 forms one discharge hole 150 together with a lower discharge hole 150 of the needle storage member 200, which will be described below, thereby enabling the needles 10 to be discharged through the discharge member 300.

An assembled boundary of the intermediate connecting member 100 which is in contact with the needle storage member 200 includes at least one coupling protrusion 120 so as to be coupled with the needle storage member 200.

Figure 19:
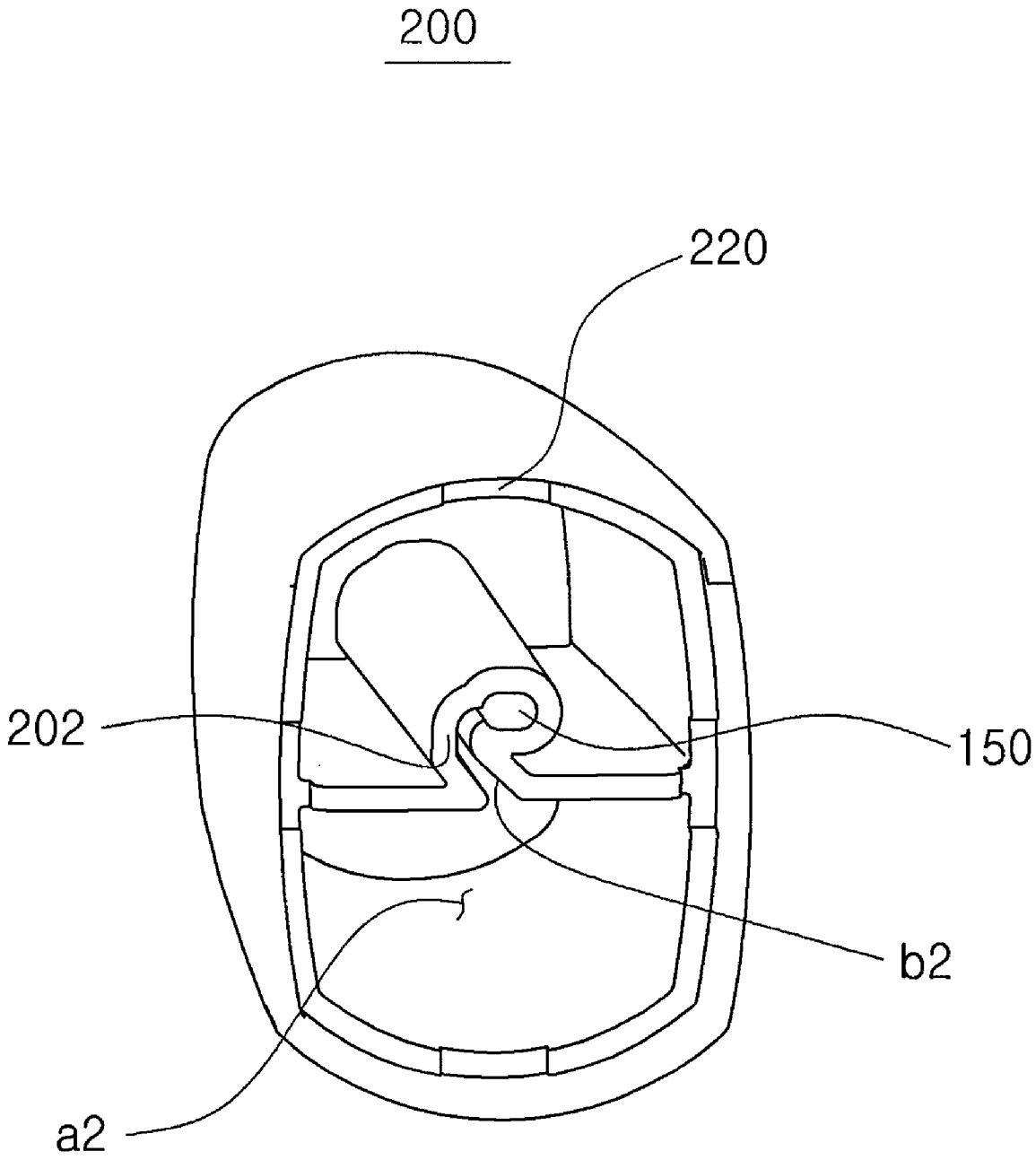
FIG. 19 is a perspective view illustrating a needle storage member of a cartridge according to a second embodiment of the present invention.

As illustrated in FIG. 19, the needle storage member 200 simultaneously forms the lower part a2 of the needle storage space a and the lower part b2 of the charge slot b so as to be assembled to the lower end of the intermediate connecting member 100, and thus the needle bodies of the arbitrarily stored needles 10 are located in the needle storage member 200.

Now, the lower part b2 of the charge slot b through which the needles 10 that are randomly stored in the needle storage member 200 forms a path through which the needles 10 are loaded so that the needles 10 of the needle storage member 200 are sequentially loaded at the striking position like the upper part b1 of the charge slot b of the intermediate connecting member 100, and is formed so as to have a cross section that is bent or curved at a predetermined angle with respect to the direction in which the magnetic force is applied to the needles 10. In other words, as illustrated in FIG. 19, the lower part b2 of the charge slot b has the bent shape, and this bent shape is identical to the bent shape of the intermediate connecting member 100.

However, as illustrated in FIGS. 18 and 19, the upper part b1 of the charge slot b formed in the intermediate connecting member 100 has a width greater than that of the lower part b2 of the charge slot b formed in the needle storage member 200. Thus, when the intermediate connecting member 100 is coupled with the needle storage member 200, a catch step 202 is formed at a boundary between the upper part b1 of the charge slot b formed in the intermediate connecting member 100 and the lower part b2 of the charge slot b formed in the needle storage member 200.

Herein, the width of the lower part b2 of the charge slot b must be formed so as to be smaller than the diameter of the needle shank 10' of each needle 10.

In detail, the upper part b1 of the charge slot b formed in the intermediate connecting member 100 is a part that is relatively wider than the lower part b2 of the charge slot b formed in the needle storage member 200 such that the needle shanks 10' of the stored needles 10 pass through the upper part b1 of the charge slot b, whereas the lower part b2 of the charge slot b formed in the needle storage member 200 is a part that is relatively narrower than the upper part b1 of the charge slot b formed in the needle storage member 200 such that the bodies 10" of the stored needles 10 pass through the lower part b2 of the charge slot b. Thus, the catch step 202 is naturally formed on a boundary of the charge slot b where the intermediate connecting member 100 is in contact with the needle storage member 200. The catch step 202 serves to support the neighboring needles 10 so as to catch the needle shanks 10' of the neighboring needles 10 when the loaded needle 10 is struck at the striking position, thereby preventing the neighboring needles 10 from being pulled downwards together with the struck needle 10.

Meanwhile, the lower part b2 of the charge slot b of the needle storage member 200 is provided with a lower discharge hole 154 so as to be connected with an upper discharge hole 152 of the intermediate connecting member 100. Since the lower discharge hole 154 and the upper discharge hole 152 communicate with each other, these holes are formed into one discharge hole 150 such that the needles 10 can be discharged through the discharge member 300.

At this time, among the discharge holes constituting the discharge hole 150, the lower discharge hole 154 located below the catch step 202 has a size larger than that of the upper discharge hole 152 located above the catch step 202, so that the struck needle 10 can be smoothly discharged. Further, the lower discharge hole 154 formed in the needle storage member 200 is preferably formed in a funnel shape so as to be able to avoid interference with the neighboring needle when the needle 10 is discharged and to induce correct positioning of the piercing of the needle during the administration of acupuncture.

The assembled boundary of the needle storage member 200 which is in contact with the intermediate connecting member 100 includes a coupling recess 220 coupled with the coupling protrusion 120 of the intermediate connecting member 100, so that the needle storage member 200 is coupled with the intermediate connecting member 100.

A reference numeral 210, which has not yet been described, indicates a needle charge opening, which is for charging the needles 10 into the needle storage space a, and is formed at the lower end of the needle storage space a of the needle storage member 200. The sterilized needles 10 can be directly and arbitrarily charged from a bag into the needle storage space a through the needle charge opening 210 without even touching the needle shanks 10' of the needles 10.

Figure 20:
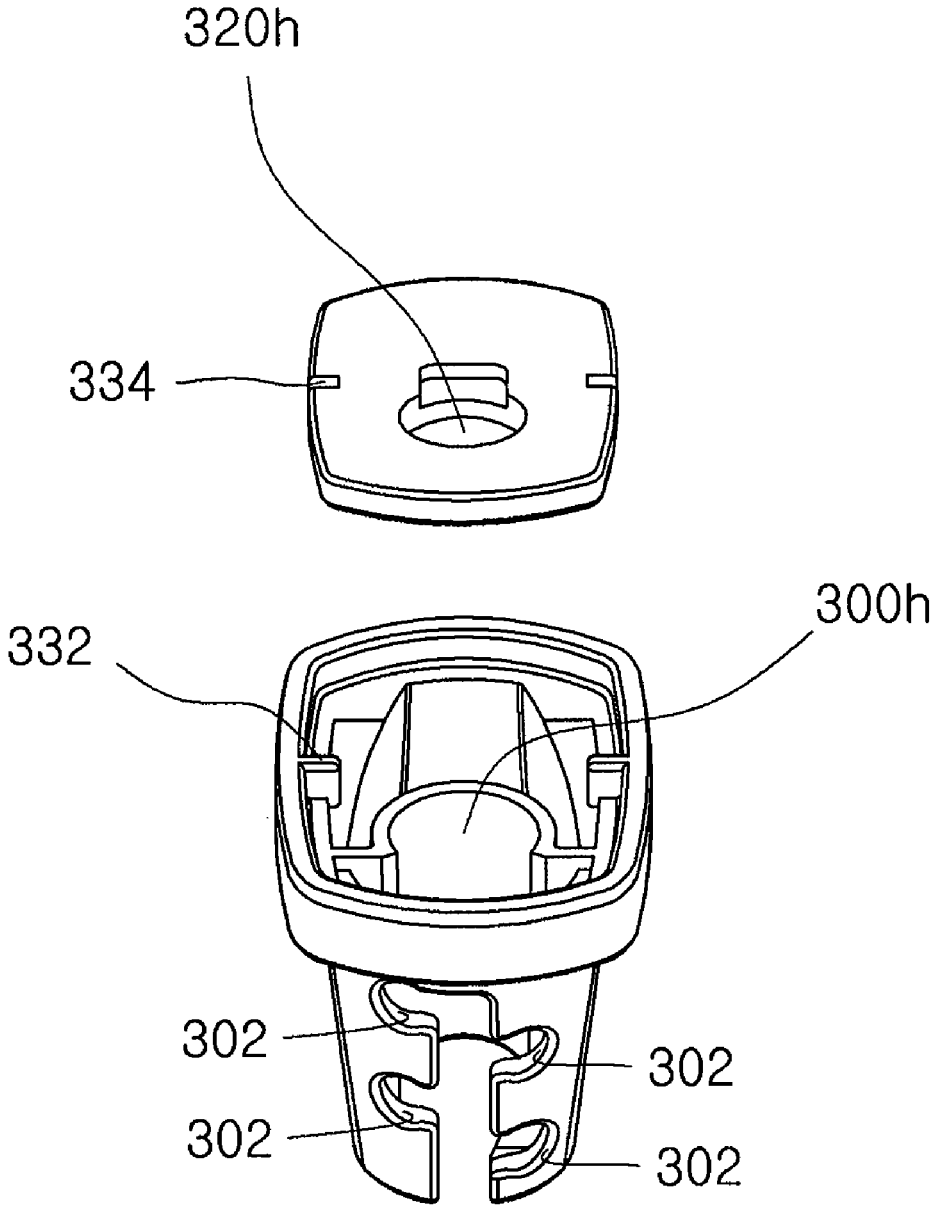
FIG. 20 is a perspective view illustrating a discharge member of a cartridge according to a second embodiment of the present invention.

As illustrated in FIG. 20, the discharge member 300 is detachably assembled to the needle charge opening 210 formed in the lower end of the needle storage member 200 such that the needles 10 can be discharged. The discharge member 300 is provided with a guide hole 300*h* for discharging the struck needle 10. A guide pipe 310 is fitted into the guide hole 300*h* so as to be able to move up and down, protrudes from the discharge member 300 in a downward direction, and adjusts a piercing depth of the needle 10 into the affected part of the patient according to a protrusion length.

In detail, the discharge member 300 includes the guide hole 300*h* in a direction where the needle 10 is struck. The guide pipe 300 discharging the struck needle 10 is movably installed in the guide hole 300*h* in a lengthwise direction. Further, the discharge member 300 is provided with a plurality of multistage slits 302 in one sidewall thereof which is spaced apart from each other at predetermined intervals in an alternate form in a direction where the needle 10 is discharged. The guide pipe 310 is provided with an adjustment pin 312 on an outer surface thereof which is caught in one of the multistage slits 37 so as to adjust the protrusion length of the guide pipe 310 and simultaneously fix the guide pipe 310, so that the piercing depth of the needle 10 can be adjusted during the administration of acupuncture.

Meanwhile, the discharge member 300 is provided with a flat pad 320 on an upper face thereof which has a through-hole 320*h* corresponding to the guide hole 300*h* so as to prevent the needles 10 stored in the needle storage space a from being dislocated toward the discharge member 300 by external impact.

In detail, the flat pad 320 supports the needles 10 stored in the needle storage space a such that the needles 10 are not dislocated from designated positions in a downward direction. In the case in which the needles 10 attracted from the needle storage space a in an upward direction by the second magnet 5 disposed on the upper side of the intermediate connecting member 100 tend to be dislocated downwards due to an accumulation of striking force resulting from external impact or consecutive applications of acupuncture, the flat pad 320 of the discharge member 300 supports the dislocated needles 10 to prevent the needles 10 from being moved downwards.

Meanwhile, the guide pipe 310 of the discharge member 300 is configured so that a stopper pin 330 is fitted into a lower end thereof. This stopper pin 330 serves to prevent the needle 10 from being discharged through the guide pipe 310 during transportation of the consecutive acupuncture device. This stopper pin 330 is removed immediately prior to use of the consecutive acupuncture device having the cartridge.

Figure 22:
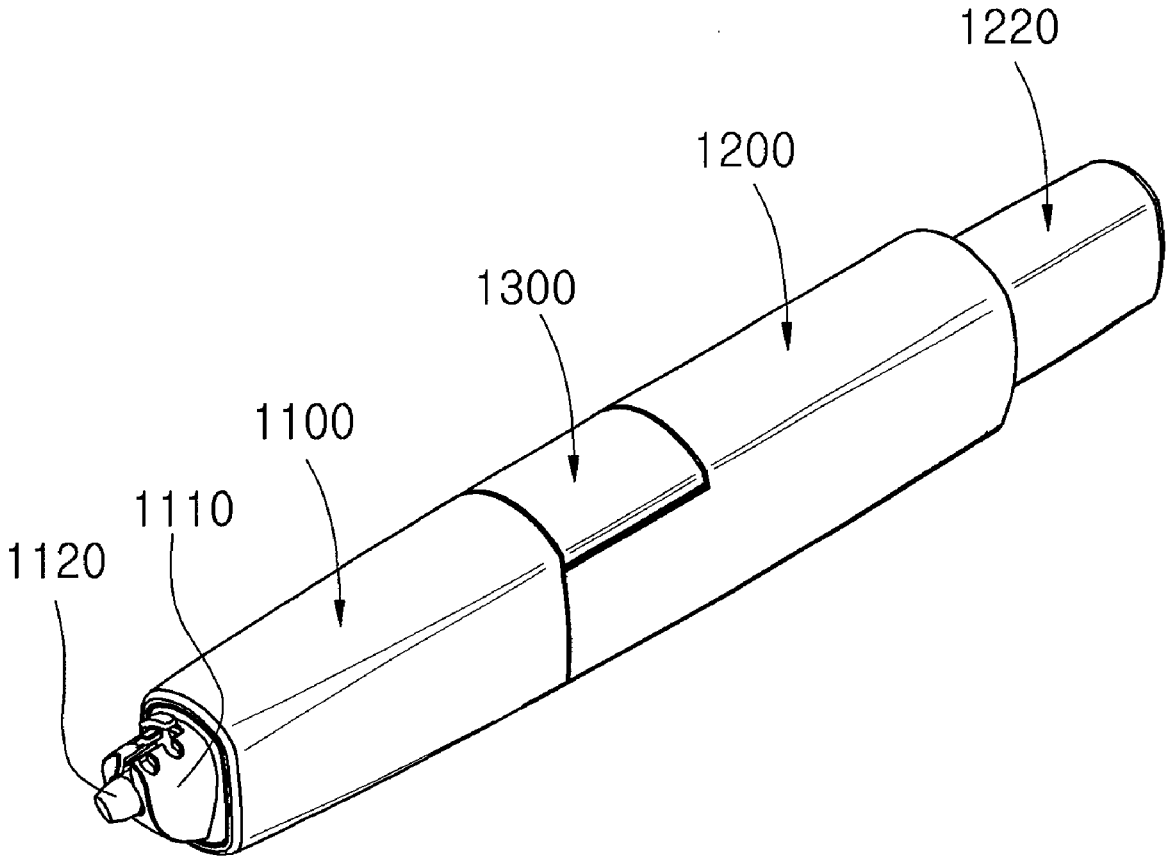
FIGS. 22 and 23 are entire perspective views illustrating a consecutive acupuncture device according to a third embodiment of the present invention.
Figure 23:
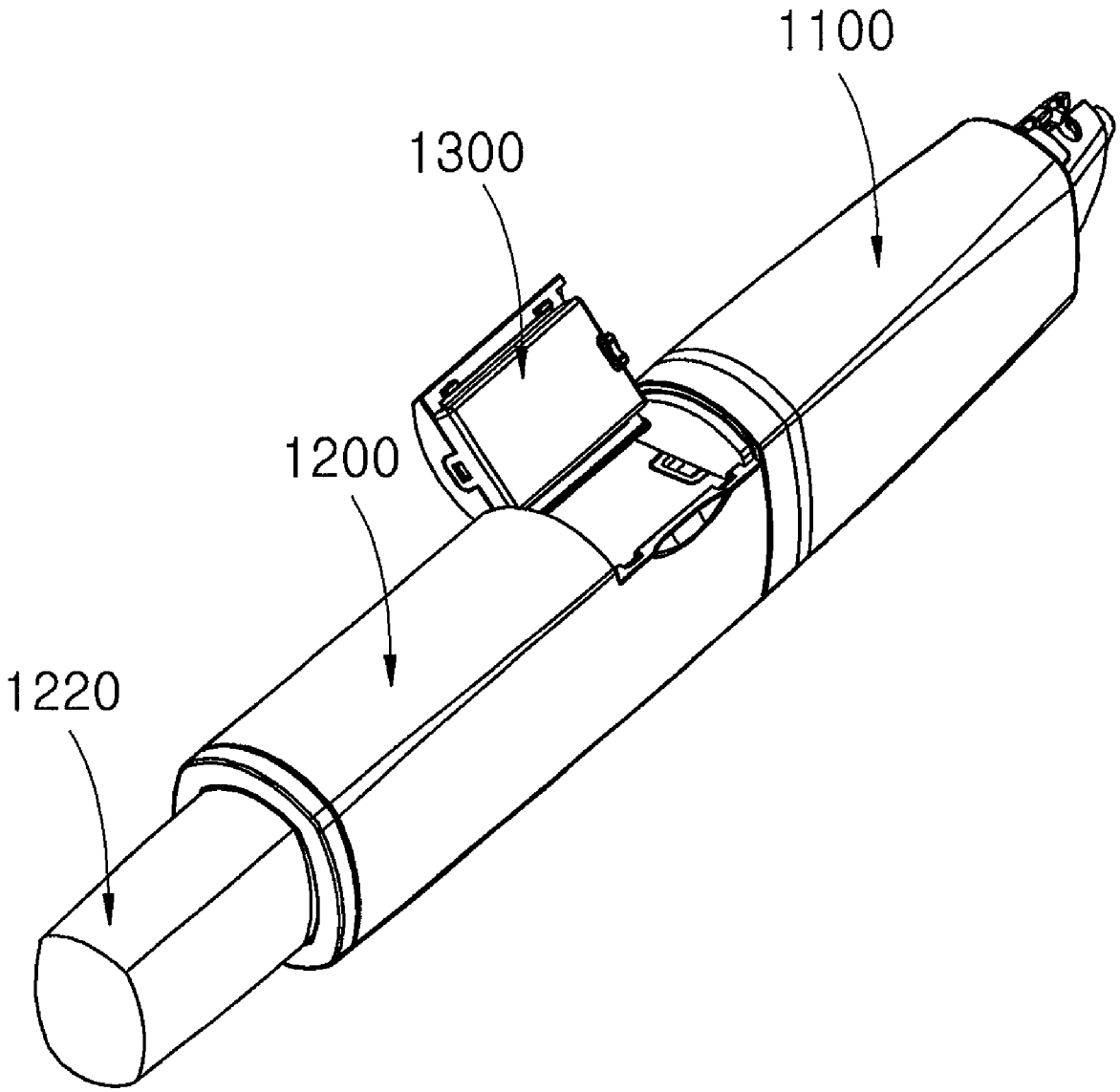
Figure 24:
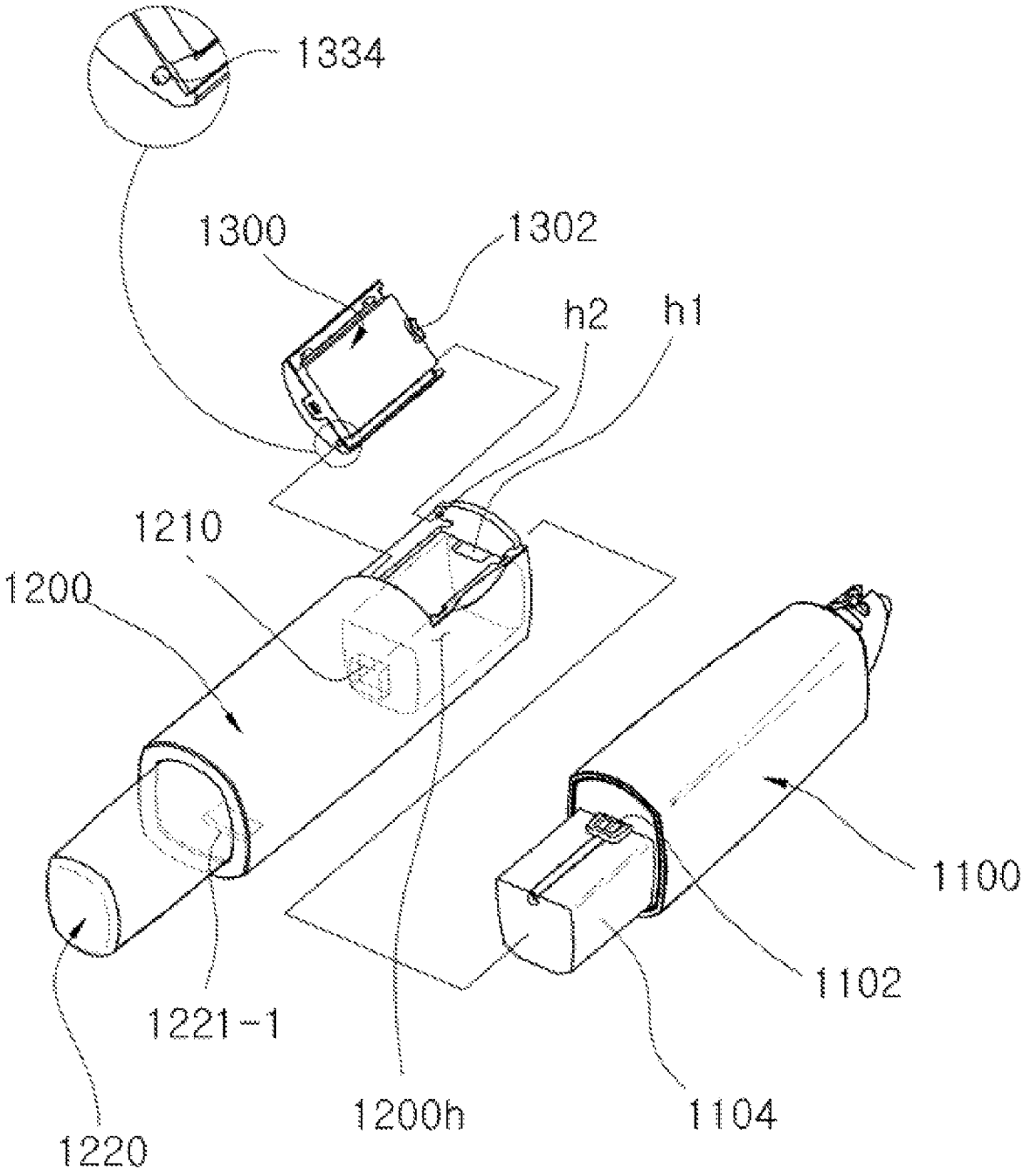
FIG. 24 is a partial disassembled perspective view illustrating a consecutive acupuncture device according to a third embodiment of the present invention.

As illustrated in FIGS. 22 through 24, the consecutive acupuncture device according to a third embodiment of the present invention generally includes a cartridge 1100, an acupuncture device body 1200, and a magnetic force generator 1300, and its detailed description is as follows.

The cartridge 1100 has at least one needle 10 charged and stored therein, and is mounted on the acupuncture device body 1200 so as to provide the needle 10 to be pierced into an affected part.

The acupuncture device body 1200 includes a mounting hole **1200*h* through which the cartridge 1100 is mounted, a second magnet 1210 attracting the needle 10 such that a needle tip 10*b* of the needle 10 stored in the cartridge 1100 mounted through the mounting hole 1200*h* is not touched on the bottom of the cartridge 1100, the magnetic force generator 1300 having a first magnet 1310, and a striking means 1220 striking the needle 10 located at a striking position of the cartridge 1100 so as to administer the needle 10** into the affected part.

The magnetic force generator 1300 in which the first magnet 1310 is mounted is pivotably hinged to one side of the acupuncture device body 1200, prevents separation of the cartridge 1100 when pivoted to a position adjacent to one side of the cartridge 1100, and causes the needle 10 to be attracted by magnetic force and thus to be automatically disposed at the striking position. Further, when the magnetic force generator 1300 is pivoted to a position away from one side of the cartridge 110, the magnetic force generator 1300 unlocks the cartridge 1100 such that the cartridge 1100 can be separated, and simultaneously prevents the needle 10 stored in the cartridge 1100 from being influenced by the magnetic force of the first magnet 1310.

Now, the cartridge 1100 and the acupuncture device body 1200 will be cursorily described below.

Figure 26:
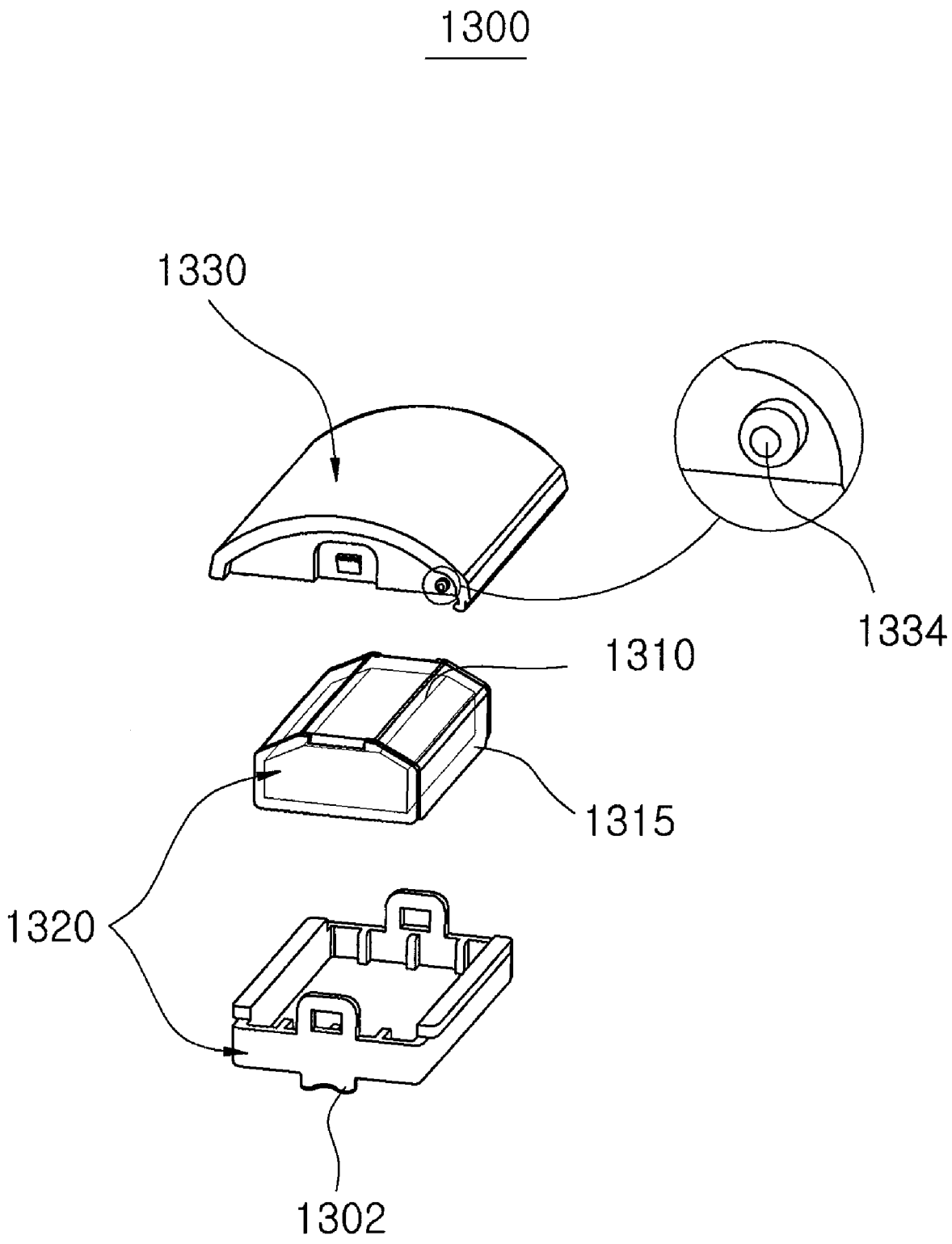
FIG. 26 is a disassembled perspective view illustrating a magnetic force generator of a consecutive acupuncture device according to a third embodiment of the present invention.

As illustrated in FIGS. 22 through 24, the cartridge 1100 is mounted onto the acupuncture device body 1200 so as to feed the needles 10 one by one, and includes a charge slot (not shown), which causes the needles 10 stored in a needle storage space formed in the cartridge 1100 to be attracted one by one to a striking position where a hammer plunger 1223-1 (see FIG. 27) of the consecutive acupuncture device strikes each needle 10 by means of the magnetic force of the first magnet 1310 (see FIG. 26). Meanwhile, the charge slot includes a discharge hole (not shown) in one end thereof through which the struck needle 10 can be smoothly discharged, and the cartridge 1100 is provided with a discharge member 1110 at a lower part thereof. A guide 1120 is coupled with the discharge member 1110 so as to be able to move up and down, protrudes downward from the discharge member 1110, and causes a depth of the needle 10 pierced into the affected part to be adjusted according to a protrusion length.

As illustrated in FIG. 24, the acupuncture device body 1200 is coupled with the cartridge 1100 so as to be gripped by the hand when used, and includes the mounting hole **1200*h* through which an inserting part 1104 of the cartridge 1100 is mounted, the second magnet 1210 attracting the needle 10 such that a needle tip 10*b* of the needle 10 stored in the cartridge 1100 mounted through the mounting hole 1200*h* does not touch the bottom of the cartridge 1100, and the striking means 1220 striking the needle 10 located at the striking position of the cartridge 1100** so as to allow piercing into the affected part.

The mounting hole **1200*h* is formed so as to have such a depth that the inserting part 1104 of the cartridge 110 can be sufficiently inserted and coupled, and has a shape corresponding to a cross-sectional shape of the inserting part 1104 of the cartridge 110. When the inserting part 1104 of the cartridge 110 is inserted into the mounting hole 1200*h*, the needles 10 stored in the cartridge 1100 are attracted upwards by the magnetic force of the second magnet 1210, so that the needle tips 10*b* of the needles 10 do not touch the bottom of the cartridge 1100**.

Subsequently, the magnetic force generator 1300 will be described.

Figure 25:
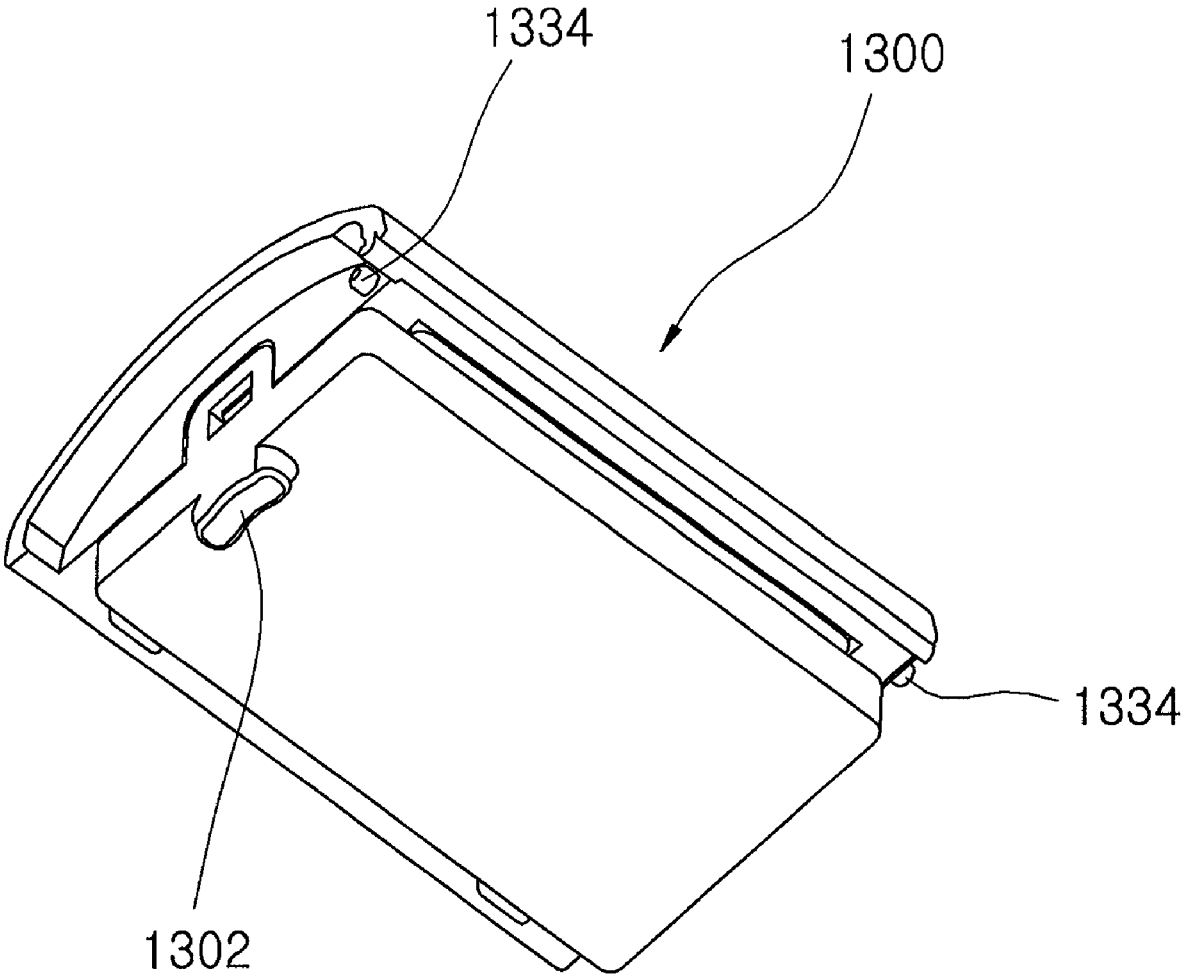
FIG. 25 is a perspective view illustrating a magnetic force generator of a consecutive acupuncture device according to a third embodiment of the present invention.

As illustrated in FIGS. 24 through 26, the magnetic force generator 1300 has the first magnet 1310 which automatically loads the needles 10 stored in the cartridge 1100, and is pivotably hinged to one side of the acupuncture device body 1200.

In detail, the magnetic force generator 1300 is pivotably hinged to one side of the acupuncture device body 1200, particularly to the side of the mounting hole **1200*h* into which the inserting part 1104 of the cartridge 110 is inserted. The acupuncture device body 1200 is provided with a plurality of hinging holes on one side which is hinged with the magnetic force generator 1300. The magnetic force generator 1300 is provided with a plurality of hinging protrusions 1334 that is fitted into the hinging holes of the acupuncture device body 1200**.

Figure 28:
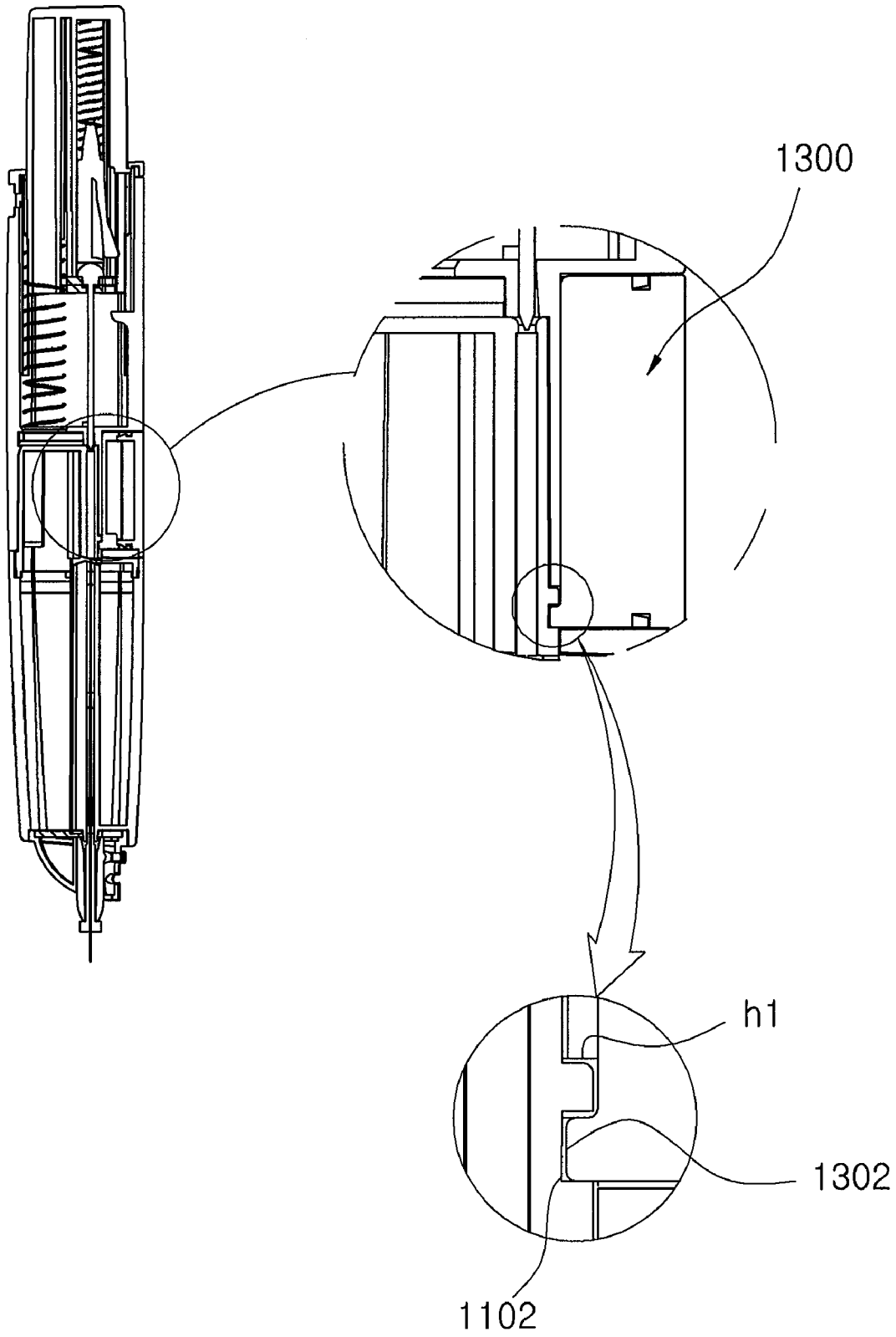
FIG. 28 is a cross-sectional view illustrating a locking protrusion and a locking recess of a consecutive acupuncture device according to a third embodiment of the present invention.

Meanwhile, the magnetic force generator 1300 includes a locking protrusion 1302, which protrudes from a corresponding face of the magnetic force generator 1300 adjacent to one side of the cartridge 1100, and the cartridge 1100 includes a locking recess 1102, which is recessed respective to a corresponding face of the cartridge 1100 corresponding to the locking protrusion 1302. Thus, as illustrated in FIG. 28, when the magnetic force generator 1300 is pivoted to a position adjacent to one side of the cartridge 1100, the locking protrusion 1302 of the magnetic force generator 1300 is fitted into the locking recess 1102 of the cartridge 1100, so that the magnetic force generator 1300 is locked onto the cartridge 1100. In contrast, when the magnetic force generator 1300 is pivoted to a position away from one side of the cartridge 110, the locking protrusion 1302 of the magnetic force generator 1300 becomes separated from the locking recess 1102 of the cartridge 1100, so that the magnetic force generator 1300 is unlocked from the cartridge 1100. At this time, the magnetic force generator 1300 is hinged on one side of the exterior of the acupuncture device body 1200, and the cartridge 1100 is inserted into the acupuncture device body 1200. Thus, the magnetic force generator 1300 is provided with a recess h1 at a position corresponding to the locking recess 1102 of the cartridge 1100 such that the locking protrusion 1302 of the magnetic force generator 1300 fixes the cartridge 1100 inserted into the acupuncture device body 1200.

The magnetic force generator 1300 as described above will now be described in greater detail. As illustrated in FIG. 26, the magnetic force generator 1300 is made up of a lower assembly 1320 which includes the first magnet 1310 placed in a casing 1315, a magnetic structure (in order to shield a magnetic field produced outside the consecutive acupuncture device), a plurality of elastic coupling recesses, and the locking protrusion 1302 formed on the lower face thereof, and an upper assembly 1330 which includes a plurality of elastic coupling protrusions coupled to the elastic coupling recesses, elastically coupled with the lower assembly 1320 while enclosing the casing 1315, and has the hinging protrusion 1334 pivotably hinged on one side of the acupuncture device body 1200. Alternatively, the magnetic force generator 1300 may be implemented as an integrated structure in which the lower assembly 1320 is integrally formed with the upper assembly 1330, and in which the first magnet 1310 is installed.

In this manner, when the magnetic force generator 1300 is pivoted and separated from the acupuncture device body 1200, the needles 10 stored in the cartridge 1100 are not influenced by the magnetic field caused by the first magnet 1320 of the magnetic force generator 1300 in whichever direction and way the cartridge 110 is inserted, and malfunction that can take place when the cartridge 1100 is incorrectly inserted can be prevented, because the needles 10 stored in the cartridge 1100 are attracted to the striking position as soon as the magnetic force generator 1300 is pivoted and coupled to the acupuncture device body 1200 in the state in which the needles 10 are attracted upwards and arranged to a predetermined height by the second magnet 1210 mounted in the acupuncture device body 1200.

Further, in the state in which the magnetic force generator 1300 is locked on the cartridge 1100, the separation of the cartridge 1100 as a result of excessive loosening resulting from repetitive coupling and decoupling, namely the separation of the cartridge 1100 from the acupuncture device body 1200, can be prevented.

Also, in the case in which the needles 10 stored in the cartridge 1100 are to be rearranged, the magnetic force generator 1300 is pivoted to render innocuous the magnetic force of the first magnet 1310 without separating the cartridge 1100 from the acupuncture device body 1200. Thereby, needles 10 stored in the cartridge 1100 can be rearranged.

Next, a position of the compression step will be described.

Figure 27:
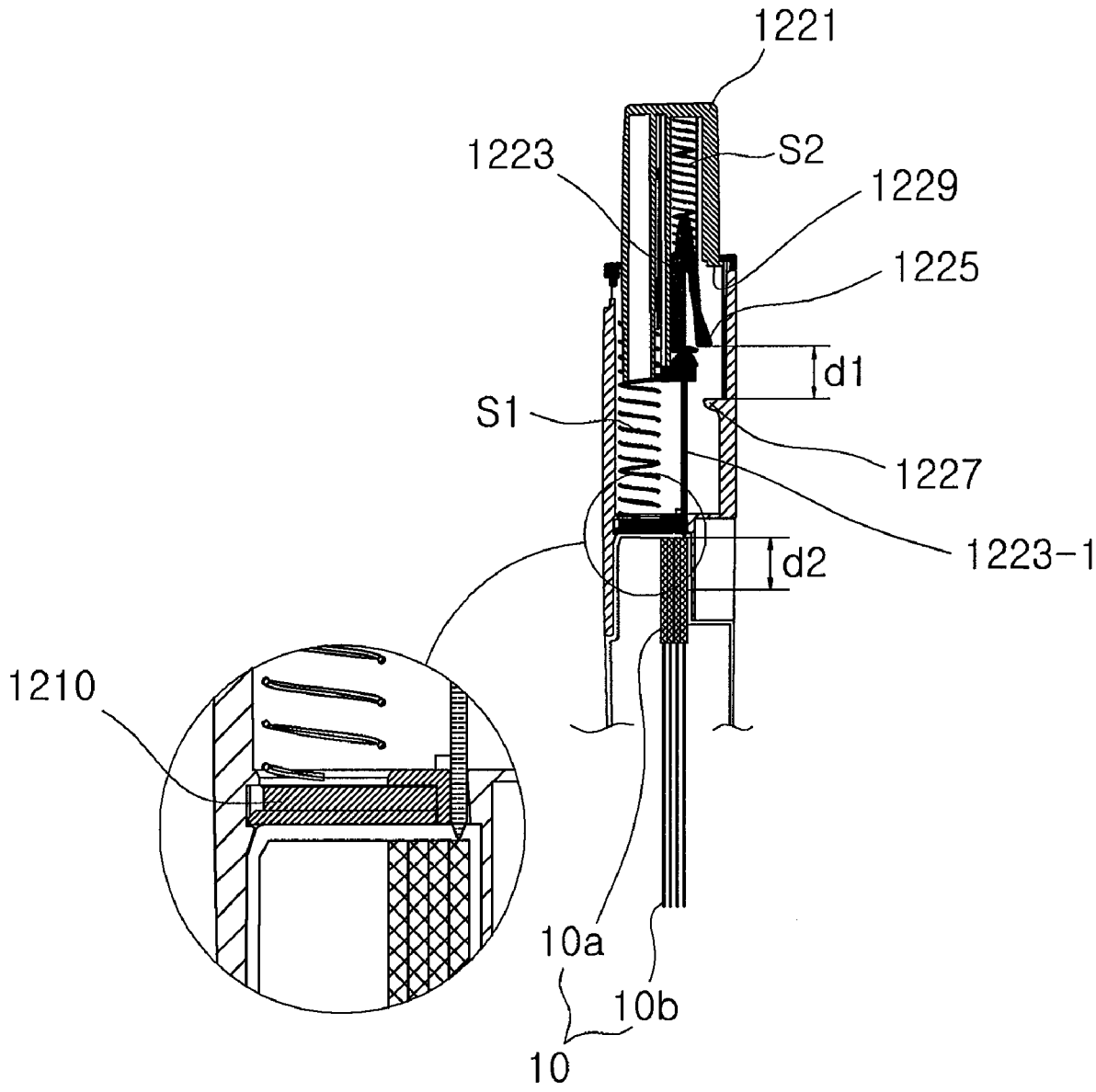
FIG. 27 is a partial cross-sectional view illustrating a consecutive acupuncture device according to a third embodiment of the present invention.

As illustrated in FIG. 27, the striking means installed in the acupuncture device body 1200 includes a button 1221 that is installed on the upper side of the cartridge 1 so as to be elastically biased upwards by a return spring S1, a hammer 1223 that is installed in the button 1221 so as to be elastically biased downwards by a striking spring S2, a hammer nose 1225 that has an ascending slope on one side of the hammer 26, a compression step 1227 that is formed on a lower side of the hammer nose such that the hammer nose 1225 is caught to compress the striking spring S2 up to a predetermined position when the button 1221 is pushed, and a release step 1229 that is formed on an upper side of the hammer nose 1225 such that the ascending slope of the hammer nose 1225 is pressed to cause the hammer nose 1225 to be separated from the compression step 1227 when the striking spring S2 is compressed up to or past a predetermined length.

At this time, a length from the end of the hammer nose 1225 to the compression step 1227 is set to a half or less of the length of a shank 10*a* of each needle 10 stored in the cartridge 1100.

In this manner, when the length d1 from the end of the hammer nose 1225 to the compression step 1227 is set to the half or less of the length of the needle shank 10*a* of each needle 10, the needle 10 located at the striking position is pushed only by the length of "d1" or less even when the hammer plunger is returned without completely striking the loaded needle 10. As such, an upper end of the incompletely struck needle is located at a position d2 below the length d1, and thus the neighboring needle continues to be arranged without leaning to one side. As a result, the malfunction resulting from carelessness of the user can be prevented.

Meanwhile, the acupuncture device body 1200 may be provided with a locking switch 1221-1 (see FIG. 24) for locking or unlocking the button 1221. This locking switch 1221-1 for locking or unlocking the button 1221 prevents the needle 10 from being discharged when the button 1221 is pushed accidentally by the user.

Up to now, the structure in which the magnetic force generator 1300 is pivotably hinged on one side of the acupuncture device body 1200 has been described. As described below, it is apparent that the structure can be modified into a detachable structure, a sliding structure, a uniaxial rotation structure, or the like.

1) Detachable Structure

The magnetic force generator 1300 is located to a position adjacent to one side of the cartridge or is separated from one side of the cartridge which is missing the hinging protrusions 1334 and hinging hole.

Figure 29:
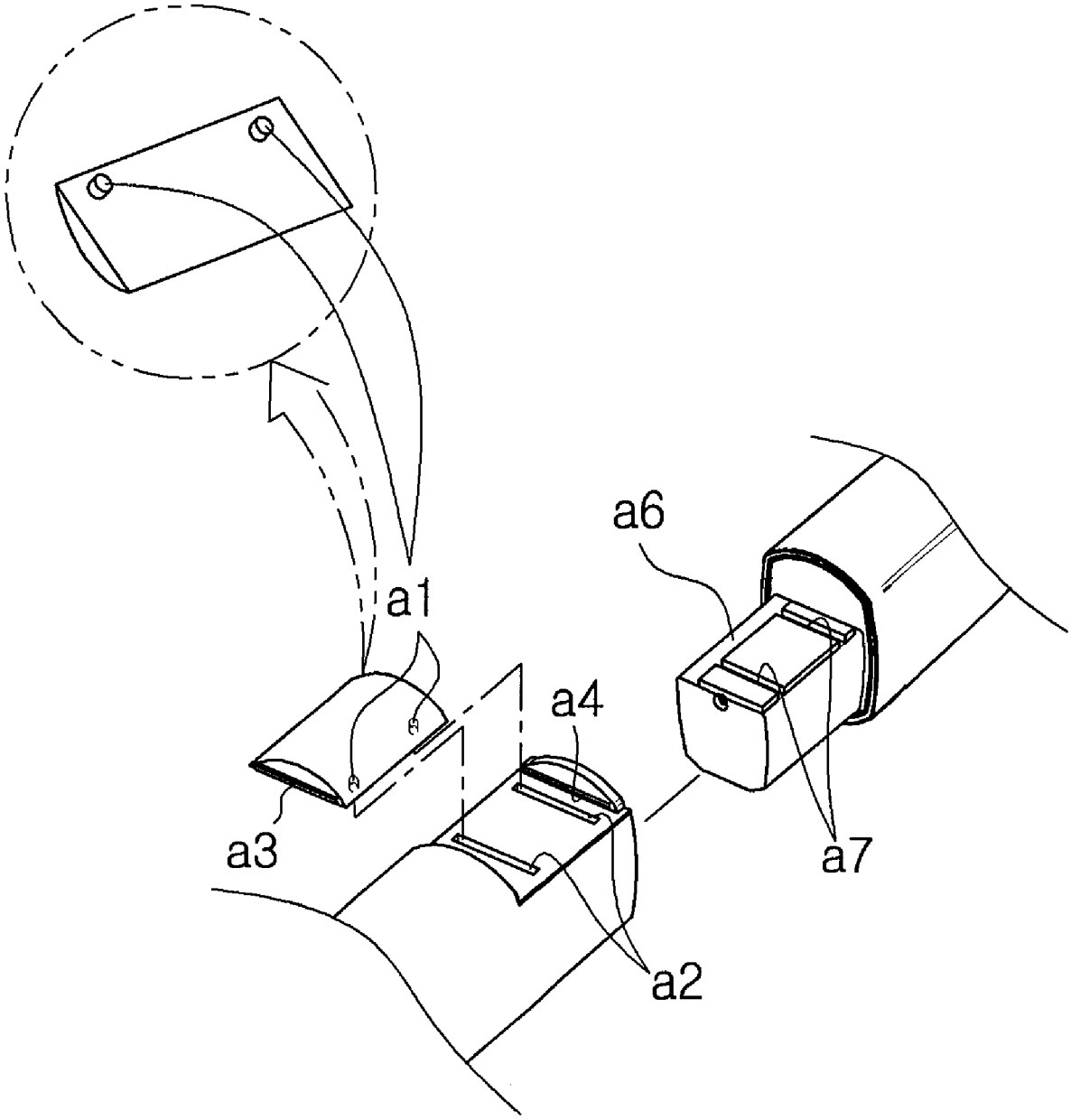
FIG. 29 is a perspective view illustrating another example of a magnetic force generator of a consecutive acupuncture device according to a third embodiment of the present invention.

2) Sliding Structure (see FIG. 29)

A pair of protrusions a1 protrudes from the lower face of the magnetic force generator. Sliding coupling protrusions are formed on opposite sides of the magnetic force generator. A pair of sliding slots a2 is formed on one side of the acupuncture device body at an interval equal to that between the pair of protrusions a1, and the cartridge is provided with a first face a6 and second faces a7.

In the case in which the cartridge is coupled to the acupuncture device body, the magnetic force generator slides to the left of FIG. 29, and then the cartridge is inserted into the acupuncture device body in the state in which lower ends of the protrusions a1 are in contact with the first face a6 of the cartridge. After the insertion is completed, the magnetic force generator slides to the right of FIG. 29 in the state in which lower ends of the protrusions a1 are in contact with the second faces a7 of the cartridge. Thereby, the cartridge is coupled to the acupuncture device body.

The pair of protrusions a1 is located on the second faces a7 in the state in which the cartridge is coupled to the acupuncture device body, so that the cartridge is inseparable from the acupuncture device body.

Figure 30:
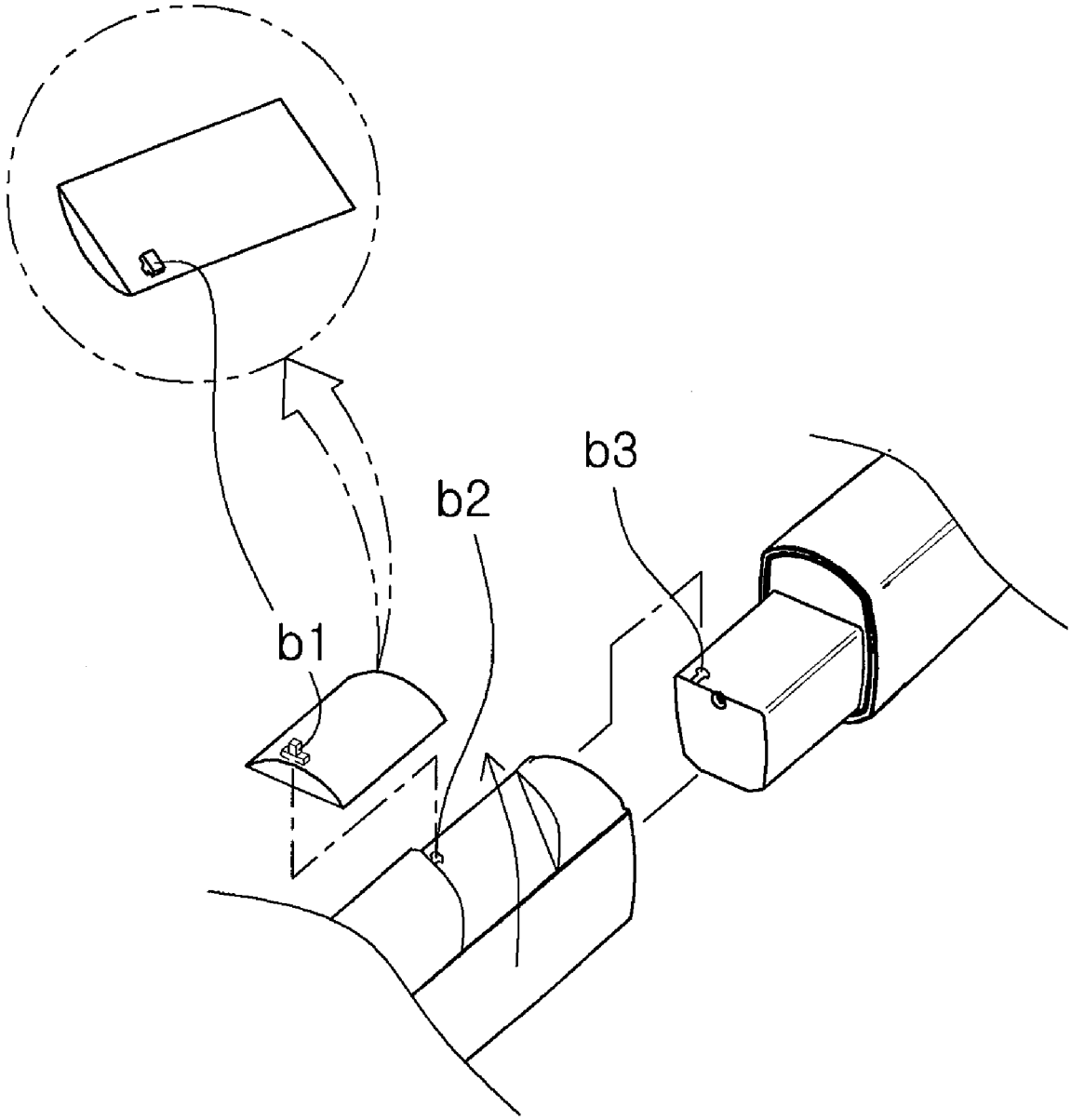
FIG. 30 is a perspective view illustrating yet another example of a magnetic force generator of a consecutive acupuncture device according to a third embodiment of the present invention.

3) Uniaxial Rotation Structure (see FIG. 30)

A linear protrusion b1 is formed on the lower face of the magnetic force generator. A first hole b2 is formed in the acupuncture device body. A second hole b3 is formed in the cartridge.

In the case in which the cartridge is coupled to the acupuncture device body, the magnetic force generator is rotated in a counterclockwise direction of FIG. 30 such that the first hole b2 is aligned with the second hole b3 in a lengthwise direction, and then the linear protrusion b1 of the cartridge is aligned with the first and second holes b2 and b3 in a lengthwise direction, and then is inserted into the first and second holes b2 and b3 at the same time. After the insertion is completed, the magnetic force generator is rotated in a clockwise direction such that the linear protrusion b1 is caught in the second hole b3 so as not to escape from the second hole b3. Thereby, the cartridge does not become separated from the acupuncture device body.

Finally, the operation of the consecutive acupuncture device configured as described above will be described.

The consecutive acupuncture device is assembled by pivoting the magnetic force generator 1300 so as to be separated from the acupuncture device body 1200, inserting the cartridge 1100 in which the needles 10 are stored into the mounting hole 1200*h* of the acupuncture device body 1200, pivoting the magnetic force generator 1300 to a position adjacent to one side of the cartridge 1100 such that the needles 10 stored in the cartridge 1100 are attracted by magnetic force and then automatically disposed at a striking position and simultaneously locking the cartridge 1100 such that the cartridge 1100 will not be separated from the acupuncture device body 1200.

In this state, when the discharge member 1110 of the cartridge 1100 is contacted with the affected part and then is lowered up to a predetermined length or more by pushing the button 1221, the hammer nose 1225 inside the button 1221 is caught on the compression step 1227, and thus the striking spring S2 elastically biasing the hammer 1223 is compressed. When the button 1221 is further lowered up to a predetermined length or more, the slop of the hammer nose 1225 is pushed by the release step 1229, and thus the hammer nose 1225 is released from the compression step 1227. Thereby, the hammer 1223 is launched by the elastic force of the striking spring S2, thereby instantaneously striking one of the needles 10 located at the striking position. In this manner, when the needle must be instantaneously struck at a high speed, pain caused by the acupuncture can be reduced. This method provides a faster striking speed as compared to an existing method of striking the needle using a needle pipe, and thus has an effect of remarkably reducing the pain when acupuncture is administered.

After the needle has been administered, the consecutive acupuncture device is raised from the affected part. The needle 10 discharged from the consecutive acupuncture device has pierced the skin at the affected part.

Subsequently, when the pushed button 1221 is released, the hammer 1223 is returned to its original position by the return spring S1. One of the stand-by needles 10 is automatically attracted to and loaded at the striking position by the magnetic force of the first magnet 1310. The aforementioned process is repeated, and the other needles 10 can be consecutively administered into other affected parts.

[Industrial Applicability]

According to the embodiments of the present invention, the consecutive acupuncture device can prevent the phenomenon of the arrangement of the needles stored in the cartridge being disturbed due to vibrations caused by external impact and frequent variation in acupuncture angle while the needles 10 are administered using the consecutive acupuncture device, and the loading inability phenomenon caused by the bottleneck phenomenon which the needles attracted to the striking position by means of the magnetic force experience at the entrance of the charge slot.

Further, the consecutive acupuncture device allows the needles stored in the cartridge to be sequentially loaded without any malfunctions resulting, so that the consumer can use the consecutive acupuncture device without anxiety, and the reliability of the consecutive acupuncture device is remarkably improved.

When the cartridge is mounted in the mounting hole of the acupuncture device body, the first magnet mounted in the magnetic force generator is pivoted and opened to one side of the acupuncture device body. Herein, because the needles stored in the cartridge are first attracted upwards and arranged up to a predetermined height only by the magnetic force of the second magnet located above the mounting hole, it is not until the magnetic force generator is subsequently coupled that the needles are attracted to one side towards the charge slot by the magnetic force of the first magnet. Thus, the arranged needles are smoothly guided to the charge slot.

Further, in the case in which the haunter plunger is returned without completely striking the loaded needle due to carelessness of the user, the neighboring needles are kept in an arranged state without leaning to one side, so that possible malfunction resulting therefrom can be prevented.

Also, although the needles stored in the cartridge are entangled, the needles of the cartridge can be rearranged so long as the magnetic force generator is pivoted to remove the magnetic force of the second magnet without separation of the cartridge.

In addition, since the cartridge is not capable of being separated after the magnetic force generator is coupled, the consecutive acupuncture device can be used by the consumer without anxiety, and, furthermore, easy usage is possible. As a result, the reliability of the consecutive acupuncture device is remarkably improved.

The invention claimed is:

1. A consecutive acupuncture device, the device comprising:

a housing including a button installed on an upper part hereof, a hammer installed in the button and a hammer plunger configured to strike an upper end of a needle, the housing having a space into which a part of an intermediate connecting member is inserted, wherein the intermediate connecting member has an upper part of a needle storage space and an upper part of a charge slot;

a needle storage member assembled to an end of the intermediate connecting member and configured to form a lower part of the needle storage space and a lower part of the charge slot; and a discharge member assembled to an end of the needle storage member and configured to discharge the needle, wherein the needle storage member, the button, the intermediate connecting member and the discharge member are separable from each other;

wherein the needle storage space stores at least one needle;

wherein the charge slot is configured to connect the needle storage space with the striking position in order to sequentially load needles at the striking position;

wherein the charge slot has a catch step formed between the upper part of the charge slot and the lower part of the charge slot, the catch step being configured to prevent any needles neighboring a needle loaded at the striking position from being discharged along with the loaded needle, and wherein a first magnet is disposed on one side of the intermediate connecting member and a second magnet is disposed on the upper side of the intermediate connecting member.

2. The consecutive acupuncture device as set forth in claim 1, wherein both sides of the entrance of the charge slot are chamfered so corners of the entrance at the opposite sides have different angles of inclination or different curvatures, or the height of one of the sides of the entrance is different from that of the other.

3. The consecutive acupuncture device as set forth in claim 1, wherein the charge slot includes a discharge hole made up of an upper discharge hole and a lower discharge hole at opposite ends thereof, and the lower discharge hole has a major axis length that is 1.5 times greater than a diameter of a shank of the needle.

4. The consecutive acupuncture device as set forth in claim 1, wherein the charge slot is bent or curved to a predetermined angle.

5. The consecutive acupuncture device as set forth in claim 1, wherein the discharge member includes a guide hole configured to discharge the needle, a guide pipe fitted into the guide hole for up and down movement, the guide pipe protruding from the discharge member in a downward direction and adjusting a piercing depth of the needle into an affected part according to a protrusion length.

6. The consecutive acupuncture device as set forth in claim 5, wherein the discharge member includes a first slit extending in an upward direction from a lower end thereof and a plurality of second slits extending in a lateral direction from the first slit in a part of an outer circumference thereof, the plurality of second slits being configured to adjust the protrusion length of the guide pipe, and the guide pipe includes a laterally extending adjustment pin on an outer circumference thereof, the adjustment pin being caught in one of the multistage slits so as to fix the guide pipe.

7. The consecutive acupuncture device as set forth in claim 1, wherein the discharge member includes a flat pad on an upper end thereof which has a through-hole at a position corresponding to the guide hole, the flat pad configured to support needles stored in the needle storage space so as to prevent the needles from being moved in the downward direction.

8. The consecutive acupuncture device as set forth in claim 5, wherein the guide pipe includes a stopper pin fitted thereinto at a lower end thereof.

* * * * *